US007650840B2

(12) United States Patent
Childs et al.

(10) Patent No.: US 7,650,840 B2
(45) Date of Patent: Jan. 26, 2010

(54) DELAY UNITS AND METHODS OF MAKING THE SAME

(75) Inventors: John Childs, Granby, CT (US); Lawrence J. Shank, III, Hartland, CT (US)

(73) Assignee: Dyno Nobel Inc., Salt Lake City, UT (US)

( * ) Notice: Subject to any disclaimer, the term of this patent is extended or adjusted under 35 U.S.C. 154(b) by 534 days.

(21) Appl. No.: 11/348,698

(22) Filed: Feb. 6, 2006

(65) Prior Publication Data

US 2006/0236887 A1 Oct. 26, 2006

Related U.S. Application Data

(60) Provisional application No. 60/650,782, filed on Feb. 8, 2005, provisional application No. 60/713,233, filed on Sep. 1, 2005.

(51) Int. Cl.
*F42C 9/00* (2006.01)

(52) U.S. Cl. ..... 102/276; 102/202.13; 102/275.3; 102/277; 102/277.1; 102/277.2

(58) Field of Classification Search ..... 102/202.13, 102/275.3, 276–277.2, 269
See application file for complete search history.

(56) References Cited

U.S. PATENT DOCUMENTS 2,436,305 A 2/1948 Johnson (Continued)

FOREIGN PATENT DOCUMENTS

| | | | |
|---|---|---|---|
| DE | 38 41 690 | A1 | 6/1990 |
| EP | 0 487 472 | A1 | 5/1992 |
| EP | 1 282 170 | A1 | 2/2003 |
| FR | 2 626 875 | | 8/1989 |
| GB | 2 049 651 | A | 12/1980 |
| JP | 57202045 | A | 12/1982 |
| WO | WO 98/51749 | | 11/1998 |
| WO | WO 2004/011396 | A2 | 2/2004 |
| WO | WO 2004/106268 | A2 | 12/2004 |
| WO | WO 2004106268 | * | 12/2004 |

OTHER PUBLICATIONS

S. H. Fischer and M. C. Grubelich, "Theoretical Energy Release of Thermites, Intermetallics, and Combustible Metals", SAND98-1176C, 24th International Pyrotechnic Seminar, Monterey, California, Jul. 1998, 58 pages.

(Continued)

*Primary Examiner*—Troy Chambers
*Assistant Examiner*—Samir Abdosh
(74) *Attorney, Agent, or Firm*—Cantor Colburn LLP

(57) ABSTRACT

A delay unit (10) comprises a timing strip (14) and, optionally, a calibration strip (20) deposited on a substrate (12). The timing and calibration strips comprise energetic materials which optionally may comprise particles of nanosize materials, e.g., a fuel and an oxidizer, optionally applied as separate layers. A method of making the delay units comprises depositing onto a substrate (12) a timing strip (14) having a starting point (14*d*) and a discharge point (14*e*) and depositing onto the same or another substrate a calibration strip (20). Timing strip (14) and calibration strip (20) are of identical composition and are otherwise configured, e.g., thickness of the strips, to have identical burn rates. The calibration strip (20) is ignited and its burn rate is ascertained. The timing strip (14) is adjusted by an adjustment structure to attain a desired delay period, preferably on the basis that the burn rate of the timing strip (14) is substantially identical to that of the calibration strip (20) and ascertaining the burn rate of the calibration strip. The adjustment may be attained by one or more of providing the timing strip with jump gaps (164), an accelerant or retardant (166*a*, 166*b*), completing the timing strip with a bridging strip (14*c*), or establishing a selected effective length of the timing strip by positioning one or both of a pick-up charge (16) and relay charge (18) over a portion of the timing strip.

22 Claims, 8 Drawing Sheets

U.S. PATENT DOCUMENTS

| | | | | |
|---|---|---|---|---|
| 3,020,610 | A | 2/1962 | Rejdak | |
| 3,050,409 | A | 8/1962 | Bayer | |
| RE25,277 | E | 10/1962 | Toulmin, Jr. | |
| 3,089,798 | A | 5/1963 | Rejdak | |
| 3,118,798 | A | 1/1964 | Winckler | |
| 3,160,537 | A | 12/1964 | Trafton, Jr. | |
| 3,168,090 | A | 2/1965 | Billhardt | |
| 3,254,970 | A | 6/1966 | Dittrich et al. | |
| 3,322,515 | A | 5/1967 | Dittrich et al. | |
| 3,325,316 | A | 6/1967 | MacDonald | |
| 3,344,210 | A | 9/1967 | Silva | |
| 3,392,015 | A | 7/1968 | Badia | |
| 3,436,248 | A | 4/1969 | Dittrich et al. | |
| 3,489,534 | A | 1/1970 | Levinstein | |
| 3,503,814 | A | 3/1970 | Helms, Jr. et al. | |
| 3,526,953 | A | 9/1970 | Levinstein | |
| 3,560,863 | A * | 2/1971 | Baumoel | 327/276 |
| 3,613,589 | A * | 10/1971 | Apstein et al. | 89/1.55 |
| 3,867,265 | A | 2/1975 | Hansson | |
| 3,899,306 | A | 8/1975 | Knopp et al. | |
| 3,941,058 | A * | 3/1976 | Gawlick et al. | 102/210 |
| 3,989,606 | A | 11/1976 | Kampert | |
| 4,068,592 | A * | 1/1978 | Beuchat | 102/215 |
| 4,126,522 | A | 11/1978 | Edlund | |
| 4,239,004 | A * | 12/1980 | Day et al. | 102/202.13 |
| 4,349,612 | A | 9/1982 | Baldi | |
| 4,374,686 | A | 2/1983 | Davitt et al. | 149/21 |
| 4,741,811 | A | 5/1988 | Lefebvre et al. | |
| 4,742,773 | A | 5/1988 | Bartholomew et al. | |
| 4,840,820 | A | 6/1989 | Schultz et al. | |
| 4,848,646 | A | 7/1989 | Morishita et al. | |
| 4,989,515 | A | 2/1991 | Kelly et al. | 102/202.9 |
| 5,015,340 | A | 5/1991 | Colombier et al. | |
| 5,031,538 | A | 7/1991 | Dufrane et al. | |
| 5,046,425 | A | 9/1991 | Gibbons, Jr. et al. | |
| 5,401,596 | A | 3/1995 | Stoilov et al. | |
| 5,406,890 | A * | 4/1995 | Marsh et al. | 102/217 |
| 5,522,318 | A | 6/1996 | Gladden et al. | 102/202.13 |
| 5,538,795 | A | 7/1996 | Barbee, Jr. et al. | |
| 5,547,715 | A | 8/1996 | Barbee, Jr. et al. | |
| 5,623,117 | A * | 4/1997 | Lewis | 102/331 |
| 5,721,493 | A * | 2/1998 | Paxton | 324/502 |
| 5,843,538 | A | 12/1998 | Ehrsam et al. | |
| 5,885,321 | A | 3/1999 | Higa et al. | 75/362 |
| 6,006,671 | A | 12/1999 | Yunan | |
| 6,062,143 | A | 5/2000 | Grace et al. | |
| 6,110,266 | A | 8/2000 | Gonzalez-Blanco et al. | 106/31.65 |
| 6,178,623 | B1 | 1/2001 | Kitazawa et al. | |
| 6,258,461 | B1 | 7/2001 | Baldi et al. | |
| 6,298,784 | B1 * | 10/2001 | Knowlton et al. | 102/275.3 |
| 6,491,766 | B1 | 12/2002 | Baldi et al. | |
| 6,534,194 | B2 | 3/2003 | Weihs et al. | |
| 6,640,719 | B1 | 11/2003 | Pacella et al. | |
| 6,692,630 | B2 | 2/2004 | Morin et al. | |
| 6,712,917 | B2 | 3/2004 | Gash et al. | 149/19.92 |
| 6,736,942 | B2 | 5/2004 | Weihs et al. | |
| 6,780,303 | B2 | 8/2004 | Colombier et al. | |
| 6,803,244 | B2 | 10/2004 | Diener et al. | 438/22 |
| 6,863,992 | B2 | 3/2005 | Weihs et al. | |
| 7,005,573 | B2 | 2/2006 | Lionetta et al. | |
| 7,026,016 | B2 | 4/2006 | Bauer | |
| 7,105,740 | B2 | 9/2006 | Allaire et al. | |
| 7,146,912 | B2 * | 12/2006 | Hallin et al. | 102/215 |
| 7,316,186 | B1 * | 1/2008 | Robinson et al. | 102/251 |
| 2001/0002297 | A1 | 5/2001 | Schweizer et al. | 428/702 |
| 2004/0031411 | A1 * | 2/2004 | Novotney et al. | 102/200 |
| 2004/0060625 | A1 | 4/2004 | Barbee, Jr. et al. | |
| 2005/0115449 | A1 * | 6/2005 | Kinley | 102/486 |
| 2005/0155752 | A1 | 7/2005 | Larson et al. | |
| 2005/0181259 | A1 | 8/2005 | Roberge | |
| 2006/0121306 | A1 | 6/2006 | Wijenberg et al. | |
| 2006/0220216 | A1 * | 10/2006 | Mizuno et al. | 257/691 |

OTHER PUBLICATIONS

A. Prakash et al., "Aero-Sol-Gel Synthesis of Nanoporous Iron-Oxide Particles: A Potential Oxidizer for Nanoenergetic Materials", Chem. Mater. 2004, 16, 1466-1471.

English Language Abstract for DE 38 41 690 A1 of Diehl GmbH & Co., publication date Jun. 13, 1990.

English Language Abstract for FR 2 626 875, "Improvements to the Means of Ignition For Fuel Gas Generators With a Soild Reactive Mass", of Office National D'Etudes et de Recherches Aerospatiales (ONERA), publication date Aug. 11, 1989.

English Language Abstract for EP 1 282 170 A1, "Short-Circuit Resistant Power Semiconductor Device", of ABB Research Ltd., publication date Feb. 5, 2003.

Gavens, A.J., et al., "Effect of intermixing on self-propagating exothermic reactions in Al/Ni nanolaminate foils", Journal of Applied Physics, vol. 87, No. 3, Feb. 1, 2000, pp. 1255-1263.

International Search Report and Written Opinion for PCT/US06/04038, mailed Jun. 26, 2008, 9 pages.

International Search Report and Written Opinion for PCT/US2007/03941, international filing date of Feb. 13, 2007, mailed Sep. 27, 2007, 8 pages.

* cited by examiner

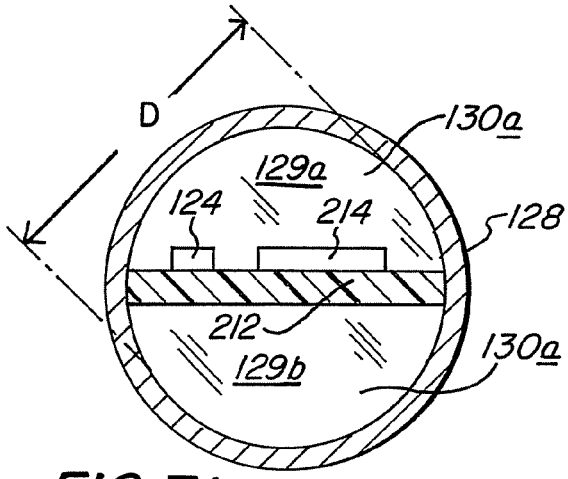
FIG. 7A
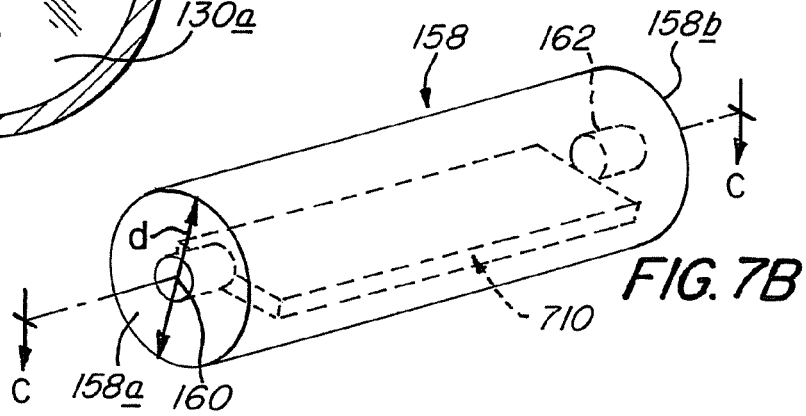
FIG. 7B
FIG. 7C
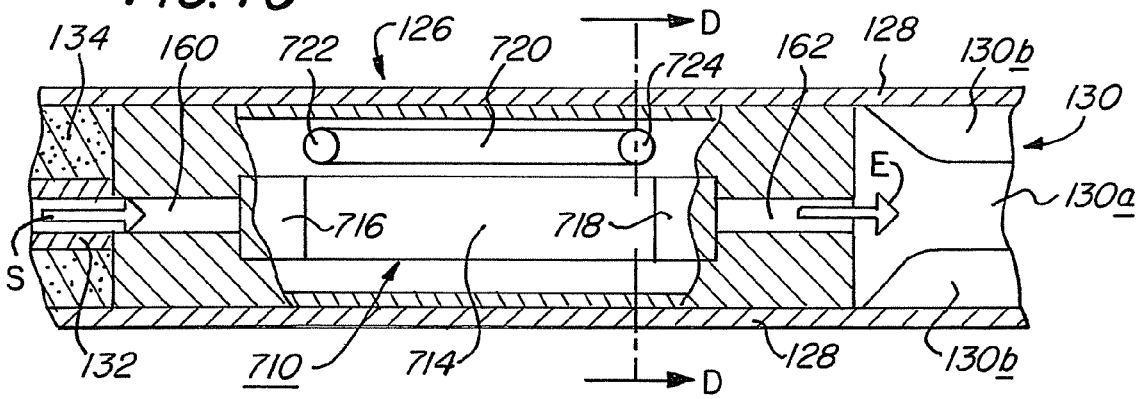
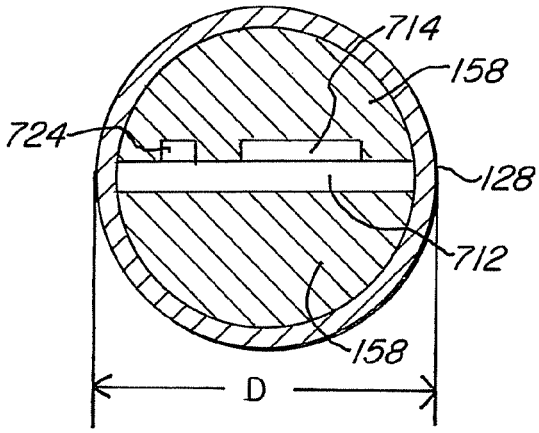
FIG. 7D
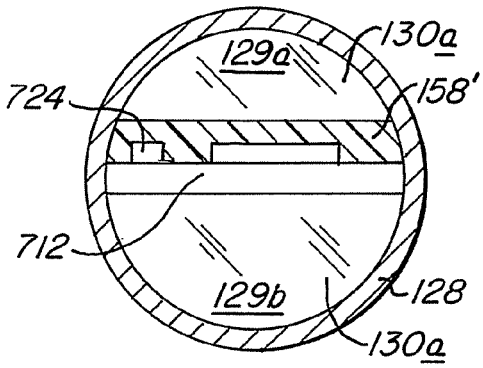
FIG. 7E

DELAY UNITS AND METHODS OF MAKING THE SAME

CROSS-REFERENCE TO RELATED APPLICATIONS

This application claims the benefit of priority of provisional Patent Application Ser. No. 60/650,782, entitled "Delay Unit and Method of Making the Same", filed on Feb. 8, 2005, and provisional Patent Application Ser. No. 60/713,233, entitled "Delay Unit and Method of Making the Same", filed on Sep. 1, 2005.

BACKGROUND OF THE INVENTION

1. Field of the Invention

The present invention concerns delay units of the type used for time-controlled initiation of energetic materials, for example, delay units of the type used in delay detonators, and methods of making such delay units.

2. Related Art

Conventional pyrotechnic delay units comprise a pulverulent pyrotechnic composition encased within a soft metal tube, such as a tube of lead or pewter. Such conventional delay units are typically placed within a detonator shell between the input signal from a fuse, such as shock tube, and the explosive output charge of the detonator. Detonation of the output explosive charge is delayed by the time it takes the length of pyrotechnic material to burn from its input to its output end. As is well known to those skilled in the art, it is necessary to very closely control the delay periods of individual detonators; typical delay periods range from 9 to 9,600 milliseconds or more, for example, 9, 25, 350, 500 and 1,000 milliseconds. Attainment of consistently accurate and precise delay times by burning of a column of pyrotechnic material is inherently limited, and the art is assiduously developing electronic delay units in order to increase delay time accuracy, despite the increased cost of electronic delay units as compared to pyrotechnic delay units.

International Application WO 2004/106268 A2 of Qinetiq Nanomaterials Limited for "Explosive Devices", published 9 Dec. 2004, discloses explosive devices printed onto substrates from inks which may contain particles as small as 10 micrometers in diameter "for even . . . 0.1 micrometer or less in diameter." (Page 4, lines 18-24.) Figures such as FIGS. 1 and 2 disclose serpentine or spiral patterns of printed explosive ink on a substrate. For example, there is described at page 15, lines 11-29, printing of the explosive ink in a single line which starts adjacent a heating element and terminates adjacent a secondary explosive material. The printed line of explosive ink initiates the secondary explosive. A zig-zag pattern may be used and will increase the delay time provided by the device.

The use of nanoporous iron oxide as the oxidizer component of propellants, explosives and pyrotechnic materials is known. See the article *Aero-Sol-Gel Synthesis of Nanoporous Iron-Oxide Particles: A Potential Oxidizer For Nanoenergetic Materials*, by Anand Prakash, Alon V. McCormick and Michael R. Zachariah, Chem. Mater. 2004, 16, 1466-1471, a publication of the American Chemical Society. The article describes the use of nanoparticles of a fuel such as aluminum and a metal oxide oxidizer, which react to liberate a large amount of energy. The high surface area per volume of material engendered by the very small particle sizes is stated to reduce mass-transfer limitations and achieve a chemical-kinetically controlled ignition. The oxidizer particles which are the subject of the invention are said to be in the 100 to 250 nanometer ("nm") size range.

UK Patent Application 2 049 651 of Brock's Fireworks Limited, Dumfriesshire, Scotland discloses a process for applying a pyrotechnic or explosive composition to a surface by screen-printing the composition in the form of a liquid slurry or paste onto the surface allowing the composition thus obtained to dry and/or harden. It is disclosed that several layers may be applied, preferably, through a coarse mesh screen which allows relatively large solid particles to pass therethrough without becoming clogged. A size range of particles is not mentioned. It is further disclosed that several layers may be applied in the described manner and each layer may be the same or different. A final layer of inert material may be overprinted for purposes of waterproofing or to prevent ignition at the surface and, if desired, flocking may be applied between steps.

U.S. Pat. No. 6,712,917 issued Mar. 30, 2004 to Gash et al and entitled Inorganic Metal Oxide/Organic Polymer Nanocomposites and Methods Thereof discloses a method of producing hybrid inorganic/organic energetic nanocomposites.

U.S. Pat. No. 6,803,244 issued Oct. 12, 2004 to Diener et al and entitled Nanostructured Reactive Substance and Process For Producing the Same discloses a nanostructured reactive substance of, e.g., silicon and an oxidizing agent. The nanometer scale size of the particles, which are initially separated by a barrier layer, is said to permit virtually direct contact between the fuel and the oxidizing agent, once the barrier layer is broken open.

A detailed discussion of thermite mixtures, intermetallic reactants and fuels is contained in the paper *Theoretical Energy Release of Thermites, Intermetallics, and Combustible Metals* by S. H. Fischer and M. C. Grubelich, of Sandia National Laboratories, Albuquerque, N. Mex. The paper, SAND-98-1176C, was presented at the 24$^{th}$ International Pyrotechnics Seminar, Monterey, Calif. in July, 1998.

SUMMARY OF THE INVENTION

Generally, in accordance with the present invention there is provided a delay unit comprised of a substrate on which is deposited a timing strip and, optionally, a calibration strip, both of energetic material. As used herein and in the claims, an "energetic material" means an explosive, a pyrotechnic or other material which emits energy upon being initiated or ignited. The energetic material may be applied by ink compositions containing particles of the energetic material dispersed in a continuous liquid phase, and some or all of the energetic material particles may be nanosize particles. Optionally, the fuel and oxidizer components may be separately applied to the substrate as discrete fuel and oxidizer layers which contact or at least partly over-lie each other. The present invention also provides for printing on a substrate a timing strip of energetic material and printing on the same or another substrate a calibration strip of energetic material similar or identical to the energetic material of the timing strip, igniting the calibration strip and ascertaining its burn rate, and modifying the timing strip to adjust its burn time on the basis that the timing strip has the same burn rate as the calibration strip. The present invention thus provides for adjusting the burn time of energetic material timing strips in a manner analogous to the interrogation of electronic delay units to ascertain that they are properly programmed to provide the desired "burn time", i.e., the desired delay period.

The capability greatly enhances the delay period accuracy and precision of energetic material, e.g., pyrotechnic, delay units.

The present invention also provides for printing or otherwise depositing on a substrate an energetic material comprised of nanosize particles. Generally, the energetic material may comprise particles dispersed in a continuous liquid phase ("an ink") and may be printed, e.g., in the form of timing strips and calibration strips, as described below. The ink is dried or allowed to dry, or hardens, into an adherent pattern on the substrate.

Specifically, in accordance with the present invention, there is provided a delay unit comprising a substrate having deposited thereon (a) at least one timing strip having a starting point and a discharge point and (b) a calibration strip, the timing strip and the calibration strip each comprising an energetic material, e.g., a fuel and an oxidizer, capable of conducting an energy-releasing reaction therealong, the calibration strip and the timing strip being separated from each other sufficiently to preclude ignition of the timing strip by the calibration strip. The energetic material may optionally comprise nanosize particles.

In one aspect of the present invention, the energetic material of at least the timing strip is comprised of at least one discrete layer of fuel and at least one discrete layer of oxidizer, one of the layer of fuel and one of the layer of oxidizer at least partly overlying the other.

In another aspect of the present invention, the energetic material of the calibration strip is substantially the same as the energetic material of the timing strip.

One aspect of the present invention provides a delay unit comprising a substrate having deposited thereon at least one timing strip having a starting point and a discharge point and comprising an energetic material capable of conducting an energy-releasing reaction therealong. The energetic material is selected from the class consisting of a fuel and an oxidizer and is comprised of at least one discrete layer of the fuel and at least one discrete layer of the oxidizer, the layer of the fuel and the layer of the oxidizer being in contact with each other.

Yet another aspect of the present invention provides that the timing strip comprises a first strip having a terminal gap, e.g., the first strip may be separated by the terminal gap from a second strip, and a bridging strip closing the terminal gap, e.g., by connecting the first strip to the second strip to close the terminal gap. The first strip, the optional second strip and the bridging strip cooperating to define the effective length of the timing strip between the starting point and the discharge point.

One aspect of the present invention provides a delay unit which further comprises at least one of (a) a pick-up charge in signal transfer communication with the starting point of the timing strip, and (b) a relay charge in signal transfer communication with the discharge point of the timing strip, and wherein a portion only of the timing strip is covered by at least one of the charges whereby the effective length of the timing strip is determined by placement of the charge or charges.

Other aspects of the present invention provide for a pick-up charge in signal transfer communication with the starting point of the timing strip and a relay charge in signal transfer communication with the discharge point of the timing strip. Optionally, a plurality of the timing strips may be connected in signal transfer communication at one end of the timing strips to the pick-up charge and at the other end of the timing strips to the relay charge, to provide redundant timing strips to initiate the relay charge.

In accordance with another aspect of the present invention, the timing strip is comprised of a major portion and a minor portion. The major portion has an effective length greater than that of the minor portion and the minor portion has a burn rate greater than that of the major portion. The disparity in the respective lengths and burn rates of the major and minor portions is great enough that the burn time of the minor portion is negligible compared to the burn time of the major portion so that the delay period of the delay unit is substantially determined by the burn time of the major portion.

A method aspect of the present invention provides for making a delay unit by steps comprising depositing onto a substrate a timing strip having a starting point and a discharge point, the timing strip comprising an energetic material comprised of at least one discrete layer of fuel and at least one discrete layer of oxidizer, with one of the layer of fuel and one of the layer of oxidizer at least partly overlying the other, and optionally further comprising depositing on the substrate a calibration strip of energetic material separated from the timing strip sufficiently to preclude ignition of the timing strip by the calibration strip.

Another method aspect of the invention provides for making a delay unit by a method comprising the following steps. (a) A timing strip having a starting point and a discharge point is deposited onto a substrate, the timing strip comprising an energetic material having a given burn rate along its length and the effective length of the timing strip being the continuous length along the timing strip between the starting point and the discharge point, the effective length and burn rate of the timing strip determining the delay period of the delay unit. (b) A calibration strip of given length having an initial point and a finish point is deposited onto the substrate, the calibration strip being comprised of an energetic material which is substantially identical to the energetic material of the timing strip. (c) The calibration strip is ignited and the time it takes for the calibration strip to burn from its initial point to its finish point is measured to thereby ascertain the burn rate of the calibration strip. (d) After carrying out step (c), the effective length of the timing strip is adjusted to attain a desired delay period on the basis that the burn rate of the timing strip is identical to the ascertained burn rate of the calibration strip.

Yet another method aspect of the invention provides for carrying out step (d) by providing one or more jump gaps in the timing strip, or by applying an accelerant to the timing strip, or by applying a retardant to the timing strip, or by applying one or both of a pick-up charge and a relay charge to cover a portion of the timing strip to leave an effective length of the timing strip between and uncovered by the charges, or by initially depositing only a portion of the timing strip by leaving at least one terminal gap between the starting point and discharge point of the timing strip and closing the gap or gaps in the timing strip with a bridging strip to provide a continuous timing strip from the starting point to the discharge point. The jump gap or gaps, the accelerant and the retardant are configured and constituted to provide a desired burn rate for the adjusted timing strip which, based on the burn rate ascertained for the calibration strip, will provide a desired delay period for the delay unit. Similarly, the bridging strip is configured and constituted and the pick-up and/or relay charges are positioned to provide the timing strip with an effective length which, at the burn rate ascertained for the calibration strip, will provide a desired delay period for the delay unit.

Various aspects of the present invention provide that the energetic material contains nanosize particles or the particles consist essentially of nanosize particles. The energetic material used in the methods of the invention may comprise a fuel and an oxidizer and the deposited energetic material may be comprised of at least one discrete layer of fuel and at least one discrete layer of oxidizer, one of the layer of fuel and the layer of oxidizer at least partly overlying the other.

Generally, at least one of the components of the energetic material is comprised of particles which may be a "nanosize" material, such as a "nanoenergetic material", e.g., a "nanopyrotechnic material"; such terms as used herein denote a particle diameter size range of from about 20 to about 1,500 nanometers ("nm"), or any suitable size range less than, but lying within, the broad range of about 20 to about 1,500 nm. For example, the particle diameter size range may be from about 40 to about 1,000 nm, or from about 50 to about 500 nm, or from about 60 to about 200 nm, or from about 80 to about 120 nm, or from about 20 to 100 nm. The exceedingly small size of particles, e.g., nanosize particles, promotes good reaction because of the intimate contact between reactive particles and enables the formation of strips having very small critical diameters. That is, strips of very small cross-sectional area are capable of sustaining reaction along their length, because of the particles of energetic material being of such small size, e.g., nanosize.

BRIEF DESCRIPTION OF THE DRAWINGS

FIG. 7A is a cross-sectional view, enlarged relative to FIG. 7 and taken along line A-A of FIG. 7;

FIG. 7B is a perspective view of a cylindrical-shaped embedment within which a delay unit similar to that illustrated in FIG. 6 is embedded;

FIG. 7C is a partial schematic view showing the embedment of FIG. 7B contained within an otherwise conventional detonator;

FIG. 7D is a cross-sectional view taken along line D-D of FIG. 7C;

FIG. 7E is a view similar to FIG. 7D but showing an alternate embodiment of an embedded delay unit contained within the shell of a detonator;

DETAILED DESCRIPTION OF THE INVENTION AND SPECIFIC EMBODIMENTS THEREOF

Unless specifically otherwise stated, or unless the context clearly requires otherwise, the following descriptions apply equally to methods and structures which comprise (1) energetic material deposited as a mixture of fuel and oxidizer, and (2) energetic material whose fuel and oxidizer components are deposited separately. When separate layers of fuel and oxidizer are applied, it is immaterial which of the fuel and oxidizer layers is first applied onto the substrate. That is, either the fuel or oxidizer layer may be the top layer, and two or more alternating layers of, respectively, fuel and oxidizer may be applied, or the separate layers may simply contact each other.

The energetic material may comprise a pyrotechnic material comprised of a fuel and an oxidizer; for example, the pyrotechnic material may, but need not necessarily, comprise a thermite material. The energetic material may be applied by printing with inks of energetic material which harden or dry on the substrate. Both fuel and oxidizer particles may be dispersed in the continuous liquid phase of a single ink. Alternatively, one ink may comprise nanosized fuel particles dispersed in a continuous liquid phase, and the other ink may comprise nanosized oxidizer particles dispersed in a continuous liquid phase. Only one of the fuel particles and oxidizer particles, or only some of the particles of each, or all the particles may be nanosized particles. At least one of the energetic material components may have a nano sol-gel structure, such as a sol-gel of nanoporous iron oxide.

Figure 1:
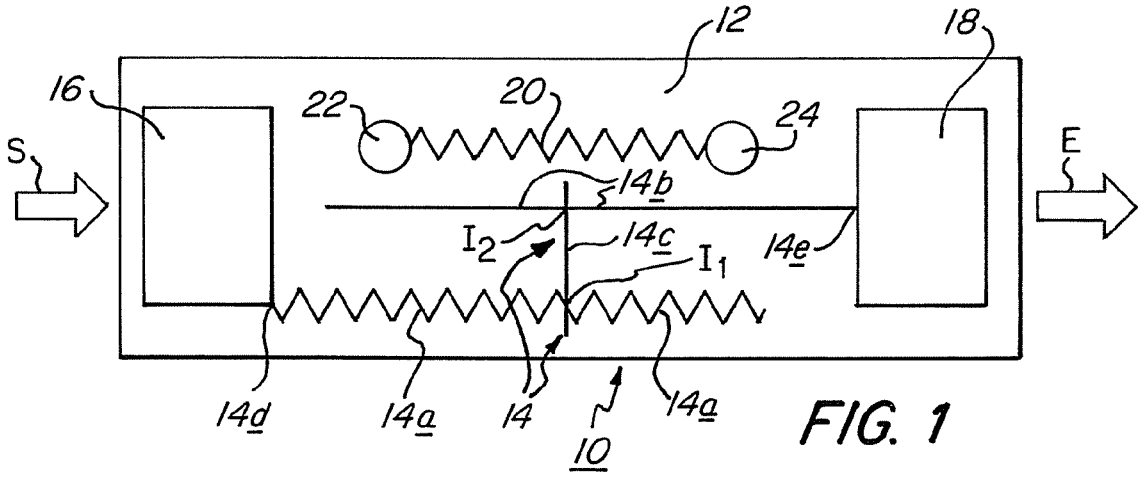
FIG. 1 is a schematic plan view of a delay unit in accordance with one embodiment of the present invention.

Referring to FIG. 1 there is schematically shown a delay unit 10 comprising a substrate 12 on which is printed or otherwise applied a timing strip 14 comprised of a first strip 14*a*, a second strip 14*b*, and a bridging strip 14*c*. A portion of timing strip 14, consisting in this embodiment of first strip 14*a*, is rendered in a saw-tooth configuration in order to increase its effective length. A terminal gap in the timing strip 14 is bridged by bridging strip 14*c*. As used herein and in the claims, a "terminal gap" means a gap in the timing strip which is large enough to terminate transmission of the ignition signal along the effective length of the timing strip. In the illustrated embodiment of FIG. 1, the terminal gap is between first strip 14*a* and second strip 14*b*, i.e., it is located at an intermediate portion of the timing strip 14. In other embodiments, the terminal gap could be at an end of the timing strip, so that the bridging strip would bridge the terminal gap between one end of the timing strip and the pick-up or relay charge, depending on the location of the terminal gap. Although more than one terminal gap could be provided in a single timing strip, that is normally not necessary and needlessly complicates calculation of the length and configuration of the bridging strip required to attain a specific delay time. A calibration strip 20 is printed or otherwise applied to the substrate and is in signal transfer communication with a start flash charge 22 at the initial point of calibration strip 20 and with a finish flash charge 24 at the finish point of calibration strip 20. Timing strip 14 and calibration strip 20 are comprised of energetic material, e.g., a nanoenergetic material. The nanoenergetic material may be a nanopyrotechnic material. Calibration strip 20 and its associated charges 22, 24 are spaced from and do not contact either timing strip 14, or its associated charges 16 and 18, which are described below.

Substrate 12 may be made of any suitable material such as conventional printed circuit board, a fiberglass-reinforced plastic, a ceramic, or any suitable material or combination of materials. For example, the substrate may comprise an electrically non-conductive material, or a material having an electrically non-conductive surface layer on which the timing strip and, optionally, a calibration strip (as described below) are printed. Substrate 12 may optionally be made of an energetic material or it may have a coating of energetic material on the surface (sometimes below referred to as "the active surface") upon which the various strips are deposited. A "reactive" substrate or coating as used herein means a substrate or coating which participates in the burn reaction of the strip or strips of energetic material. For example, a substrate or coating which supplies oxygen to the burn reaction, such as an oxygen-containing metal compound, e.g., potassium nitrate, would be a reactive substrate or coating.

A significant advantage of the present invention is that it enables adjusting the timing strip, such as timing strip 14, based on the result attained by functioning the calibration strip, such as calibration strip 20. This adjustment may be carried out in a number of different ways as described below in connection with certain of the Figures. Generally, adjusting the timing strip may comprise one or more of adding to it an accelerant or a decelerant to either increase or decrease the burn rate of the timing strip; providing one or more jump gaps in the timing strip to slow down the burn rate, adjusting the effective length of the timing strip either by initially applying only a portion of the timing strip and completing the timing strip so as to impart to it a selected effective length based on the burn rate as determined by functioning the calibration strip or positioning one or both of charges, such as charges 16 and 18 described below, to leave between them a desired uncovered (by the charges) effective length of the timing strip.

Timing strip 14 has a starting point 14*d* and a discharge point 14*e*. The "effective length" of a timing strip is the continuous length along the timing strip between its starting point and discharge point. Thus, the effective length of timing strip 14 starts at starting point 14*d*, traverses a portion of first strip 14*a* to a first intersection point $I_1$ with bridging strip 14*c*, traverses a portion of bridging strip 14*c* to a second intersection point $I_2$ with second strip 14*b*, and then traverses that portion of second strip 14*b* between the second intersection point 12 and discharge point 14*e*. It is seen that terminal portions of strips 14*a* and 14*b* are excluded from the effective length of timing strip 14 because of the particular location of intersection points $I_1$ and $I_2$ in the illustrated embodiment. Similarly, terminal ends of bridging strip 14*c* are excluded from the effective length of timing strip 14 because they extend slightly beyond the first and second intersection in order to insure a good connection between bridging strip 14*c* and strips 14*a* and 14*b*.

Starting point 14*d* is connected in signal transfer communication to a pick-up charge 16 disposed on substrate 12, and discharge point 14*e* is in signal transfer communication with a relay charge 18 also disposed on substrate 12. Pick-up charge 16 and relay charge 18 may be printed on substrate 12 in a manner similar or identical to that used to print timing strip 14 and calibration strip 20. Alternatively, charges 16 and 18 may be applied to substrate 12 by any other suitable means. Charges 16 and 18 may, but need not, be comprised of energetic nano materials.

In the various embodiments of the invention, the timing strip is deposited on the substrate and has a starting point which is positioned to receive an input signal, and a discharge point which is spaced from the starting point and positioned to initiate an output signal. The length of the timing strip between the starting point and the discharge point, i.e., the longitudinal distance along the timing strip between its starting and discharge points, is its effective length; the burn time of the effective length of the timing strip determines the time delay between the timing strip's receipt of the input signal and its initiation of the output signal. The timing strip may be configured in a straight, curved, zig-zag or other pattern, to provide a desired effective length of the timing strip. The substrate may optionally be a reactive substrate which participates in or contributes to the reaction of the energetic material in the timing strip (and, optionally, in a calibration strip, as described below).

Generally, the pick-up charge at the starting point of the timing strip is in signal transfer relationship with the output of a signal transmission fuse, and the relay charge at the discharge point of the timing strip is in signal transfer communication with an output explosive charge of an explosive device, such as a delay detonator, incorporating the delay unit of the invention. Thus, generally, one or both of: (1) a pick-up charge is disposed in signal transfer communication between the output of a signal transmission fuse and the starting point of the timing strip, and (2) a relay charge is disposed in signal transfer communication with the discharge point of the timing strip. The pick-up and relay charges may be deposited on the substrate by printing or any other suitable means.

The saw-tooth configuration of some of the strips is used simply to provide a longer effective length of strip within the limited area provided by substrate 12. Obviously, any suitable pattern of strips (spiral, serpentine, etc.) may be utilized. Substrate 12 may, of course, be of any size suitable for the intended use of the delay unit. For a delay unit which is intended for use in a standard size detonator shell, as described below, substrate 12 would typically have a width selected to approximate the inside diameter of the detonator shell so as to fit snugly therein. A mounting frame (not shown in the drawings) sized to snugly fit within the detonator shell may optionally be utilized to support the substrate 12 which would be appropriately sized to fit the mounting frame. Substrate 12 would typically have a length of from about one-quarter inch (0.64 cm) to about 1.2 inches (3.05 cm) to easily fit within a standard size detonator shell. Substrate 12, which may be made of conventional printed circuit board, need be only thick enough to provide sufficient rigidity and mechanical strength to be manipulated during manufacture and installation in an explosive device without physical distortion of the strips on the active surface. For example, substrate 12 may be from about 1/16 to 1/8 inch (0.159 to 0.318 cm) thick. Arrows S and E in FIG. 1 are described below.

Delay unit 10 may be manufactured by the following method. A suitable substrate 12 has printed (or otherwise applied) thereon first strip 14*a*, second strip 14*b* and calibration strip 20. A terminal gap is left between strips 14*a* and 14*b*. Strips 14*a*, 14*b* and 20 (sometimes, with a bridging strip, collectively referred to below as "the applied strips") are all printed or otherwise applied from the same batch of ink or from identical batches of ink. Start flash charge 22 and finish flash charge 24 may be printed or otherwise applied to substrate 12 by any suitable means and may, but need not, be applied to substrate 12 simultaneously with the application of strips 14*a*, 14*b* and 20. Pick-up charge 16 and relay charge 18 are applied to the active surface of substrate 12 by any suitable means. Charges 16, 18, 22 and 24 may, but need not, be comprised of nanosized materials.

Delay unit 10 may be subjected to a test unit which ignites start flash charge 22. An accurate reading of the time period required for calibration strip 20 to burn and ignite finish flash charge 24 is taken by any suitable measuring device. The time period required for calibration strip 20 to burn from charge 22 at the initial point of calibration strip 20 to charge 24 at the finish point of calibration strip 20 is, for example, readily read electronically by measuring the time delay between the two flashes engendered by charges 22 and 24. That measured time interval and the known length of calibration strip 20 enables ready calculation of the burn rate (distance per unit time, e.g., centimeters per second) of calibration strip 20. The burn rate of calibration strip 20 will be substantially identical to the burn rate of timing strip 14 because timing strip 14 is printed from the same or identical batches of energetic material ink as calibration strip 20 and, preferably, during the same manufacturing operation and under the same printing conditions. Preferably, the timing and calibration strips are of identical thickness and width and are disposed on the same substrate or on identical substrate material, to promote burning of the timing strip 14 and calibration strip 20 at substantially identical rates. In other embodiments, the entirety of timing strip 14 is made from the same energetic material ink as used for calibration strip 20.

Once the burn rate is known, i.e., the speed of travel of the signal along the timing strip 14, the configuration of a bridging strip 14*c* and its points of intersection with first strip 14*a* and second strip 14*b* may be selected so that the effective length of the burn from starting point 14*d* to discharge point 14*e* yields the desired delay period for delay unit 10. Bridging strip 14*c* is applied after application of strips 14*a* and 14*c* in cases where calibration strip 20 is to be used to determine the effective length of timing strip 14. Once that is determined, subsequent delay units 10 may be made by applying strips 14*a*, 14*b* and 14*c* without using calibration strip 20. Therefore, strips 14*a*, 14*b* and 14*c* may be applied simultaneously or in any desired order. Calibration strip 20 may be used when new batches of energetic material inks are used, or at specified intervals as a quality control check. The effective length of the timing strip 14 which is needed to provide a specific delay period is accurately determined by the destructive testing of the calibration strip 20.

After the applied strips and charges dry or harden, any desired post-printing treatment or processing of delay unit 10, such as the optional application of a lacquer, a laminate or other coating to "the active surface" (the surface of substrate 12 to which the strips are applied), may be carried out. Alternatively, or in addition, a potting compound may be used to enclose the timing strip 14 or portions thereof, and/or charges 16 and 18. The optional laminate or coating may be inert to the burn reaction or it may comprise an oxidizer or a fuel or both which participate in the burn reaction of the printed strips. For example, alternate layers of a fuel and oxidizer may be applied as a coating over the applied strips. In one embodiment, an oxidizer layer may be applied directly over the applied strips, overlain by a fuel layer which in turn is overlain by another oxidizer layer. Specific oxidizers and fuels usable in the applied strips and in the optional coating layers are described below. Oxidizer and/or fuel coating layers ("reactive layer(s)") may be applied with a discontinuity between the reactive layer(s) overlying calibration strip 20 and those overlying timing strip 14, in order to insure that ignition of calibration strip 20 does not also ignite timing strip 14.

The timing strip 14 and the calibration strip 20 may be applied to substrate 12 by any suitable printing or deposition technique such as those used in the printing and graphics industries. These include, by way of illustration and not limitation, silk screening, ink-jet printing, stenciling, transfer printing, gravure printing and other such techniques.

The illustrated embodiment of FIG. 1 may be configured to provide any desired delay time, from a maximum attainable by utilizing the full length of second strip 14*b* and first strip 14*a*, to a minimum attainable by printing bridging strip 14*c* to provide the shortest route along the timing strip between charges 16 and 18. For example, the configuration of the strips illustrated in FIG. 1 may be modified in any number of ways. Thus, by selecting the configuration (straight line, saw-tooth, curved, etc.) of bridging strip 14*c* and the points on first strip 14*a* and second strip 14*b* to which bridging strip 14*c* is connected, the effective length of timing strip 14 may be adjusted as desired. Other expedients include rendering straight line portions of one or more of the strips in saw-tooth configuration, or vice versa, or otherwise changing the configuration of the strips to attain any one of a large number of delay times.

It will be appreciated that numerous variations may be made to the strip pattern illustrated in FIG. 1. For example, the second strip 14*b* may be omitted and the bridging strip 14*c* may be printed along any desired path, straight line, saw-tooth, direct or circuitous, between any selected point on first strip 14*a* and relay charge 18 of FIG. 1.

In some embodiments, a portion of timing strip 14, e.g., bridging strip 14*c* and, optionally, second strip 14*b*, may comprise an energetic material which burns at a substantially faster rate than does first strip 14*a*. In this arrangement, the faster-burning strip or strips are made as short as is feasible and their composition is selected to burn at as high a rate as is feasible, so that the total burn time of the effective length of the faster-burning strip or strips is negligible compared to the burn time of first strip 14*a*. The calculations for the configuration and placement of bridging strip 14*c* are thereby simplified, because only the effective length of first strip 14*a* which will yield the desired delay time must be taken into account. For example, referring to FIG. 1, first portion 14*a* may be comprised of relatively slow burn rate energetic material and second portion 14*b* and bridging portion 14*c* may be made of a relatively fast burn rate energetic material. The combined lengths of bridging portion 14*c* and second portion 14*b* may be made much shorter than the length of first portion 14*a*, so that second portion 14*b* and bridging portion 14*c* together comprise a "minor portion" (of the effective length)

of timing strip 14 and first portion 14*a* comprises a "major portion" of the effective length of timing strip, strip 14. The length of first portion 14*a* which is included in the effective length of timing strip 14 is determined by the point along first portion 14*a* which is intersected by bridging portion 14*c*. If the disparities in burn rates and respective lengths of the major and minor portions is great enough, the burn time along portions 14*b* and 14*c* ("the minor portion") will be negligible compared to the burn time along that portion of first portion 14*a* which is included in the effective length of timing strip 14 ("the major portion"). The "burn time" is the length of time it takes for the signal to travel along the designated portion (length) of the timing strip. In other embodiments, second portion 14*b* could be eliminated and bridging strip 14*c* alone would be used to connect first portion 14*a* to relay charge 18. In any case, the use of a fast burn rate energetic material to connect a selected location along a relatively slow burn rate first portion 14*a* to relay charge 18, simplifies calculations as only the burn time of the included length of first portion 14*a* must be taken into account to determine the delay period.

Figure 2:
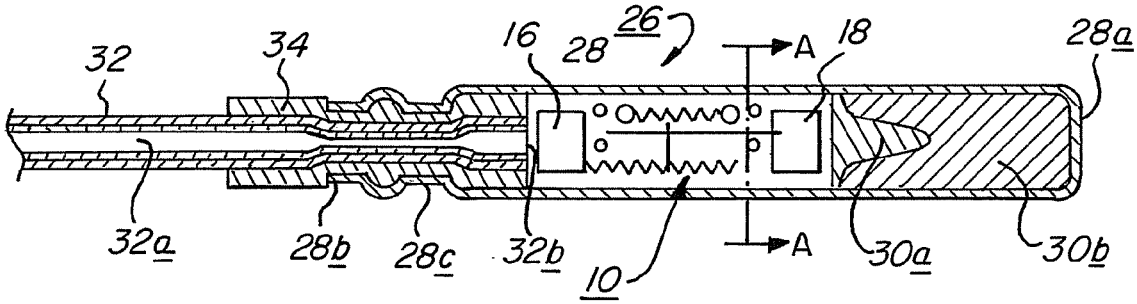
FIG. 2 is a schematic cross-sectional longitudinal view of a delay detonator equipped with the delay unit of FIG. 1.

FIG. 2 shows a schematic rendition of the delay unit 10 of FIG. 1 incorporated into an otherwise conventional detonator. FIG. 2 shows a detonator 26, comprising a shell 28 having a closed end 28*a* and an open end 28*b*. An explosive charge, for example, a detonator output charge 30 having a lead azide initiating charge 30*a* and a PETN main charge 30*b*, is contained within the shell at closed end 28*b*. Detonator 26 receives at its open end 28*b* a signal transmission fuse comprising, in the illustrated embodiment, shock tube 32 which contains an energetic material (not shown) coated on its interior wall 32*a*. Bushing 34 is positioned to seal open end 28*b* and is retained in place by a crimp 28*c* formed in the shell 28 to seal the interior of the shell 28 from the environment, as is well-known in the art. In lieu of a conventional pyrotechnic delay interposed between the output end 32*b* of shock tube 32 and detonator output charge 30, there is provided the delay unit 10 of FIG. 1. Conventional components of the detonator 26, such as an isolation cup to prevent inadvertent discharge by static electricity, cushion discs, wiper rings, etc., are omitted from the schematic rendition of FIG. 2 inasmuch as such expedients are well-known to those skilled in art and form no part of the present invention.

As is well-known to those skilled in the art, an initiation device (not shown) ignites the energetic material contained within shock tube 32. The resulting input signal (represented in FIG. 1 by arrow S) travels through shock tube 32 and initiates pick-up charge 16, which in turn ignites first strip 14*a* at the starting point 14*d* thereof. First strip 14*a* burns and after a time ignites bridging strip 14*c* which in turn ignites second strip 14*b*. When the burning of second strip 14*b* reaches discharge point 14*e*, relay charge 18 is ignited and the output energy signal (represented by arrow E in FIG. 1) thereby engendered ignites initiating charge 30*a*, which in turn ignites main charge 30*b*, thereby providing the output explosive energy of detonator 26.

Figure 2A:
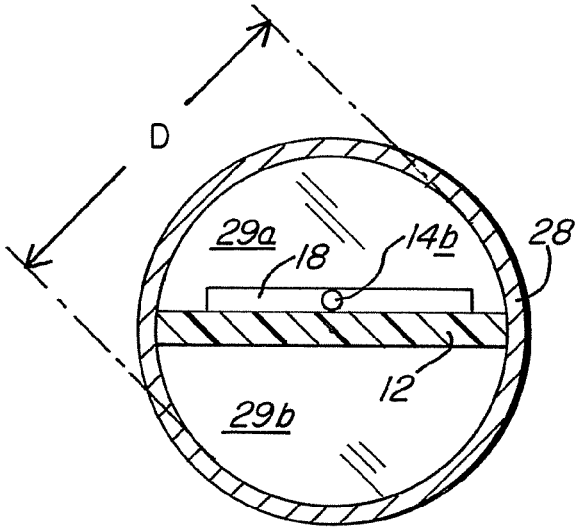
FIG. 2A is a cross-sectional view, enlarged relative to FIG. 2 and taken along line A-A of FIG. 2.

The delay unit of the present invention may be inserted within a conventional detonator shell 28 (FIGS. 2 and 2A) and configured to leave a substantial volume of free space 29*a*, 29*b* on either side of delay unit 10 within shell 28, as shown in FIG. 2A. The inside diameter D (FIG. 2A) of a conventional detonator shell 28 is 0.256 inch (0.650 cm). It will be appreciated that delay units of the present invention may be incorporated into any suitable device; incorporation of them into a delay detonator is but one of any number of potential uses.

As noted above, the processing requirements of conventional pyrotechnic delay elements include filling a lead or pewter tube with a pyrotechnic composition and drawing the tube down to a significantly reduced diameter. This involved processing step is omitted by the practices of the present invention, which require only a printing operation to make the pyrotechnic delay. The present invention thus significantly reduces material requirements and processing requirements, while providing pyrotechnic delays of greatly enhanced accuracy.

The present invention also provides the option of providing and utilizing a calibration strip on the substrate to further enhance the accuracy of delay times provided by timing strip 14. The calibration strip may be deposited on the same substrate on which the timing strip is deposited, or it may be deposited on a separate, test substrate. The timing strip and calibration strip may be deposited from the same ink or inks at about the same time and under the same or similar conditions to help insure that they have the same, or nearly the same, burn rate. Optionally, at least one, and preferably both, of the timing strip and the optional calibration strip are applied as discrete layers of fuel and oxidizer. Despite taking the greatest care in preparing energetic materials, including energetic inks as contemplated by the present invention, variations nonetheless occur from batch to batch. The provision of a calibration strip which is substantially identical to all or part of the timing strip, and use of the calibration strip during the manufacturing process to time the burn rate along the calibration strip and configure the timing strip accordingly, enables extremely close control and reproducibility of a desired delay period. This advantage is not available to conventional pyrotechnic delays and manufacturing techniques.

Figure 3:
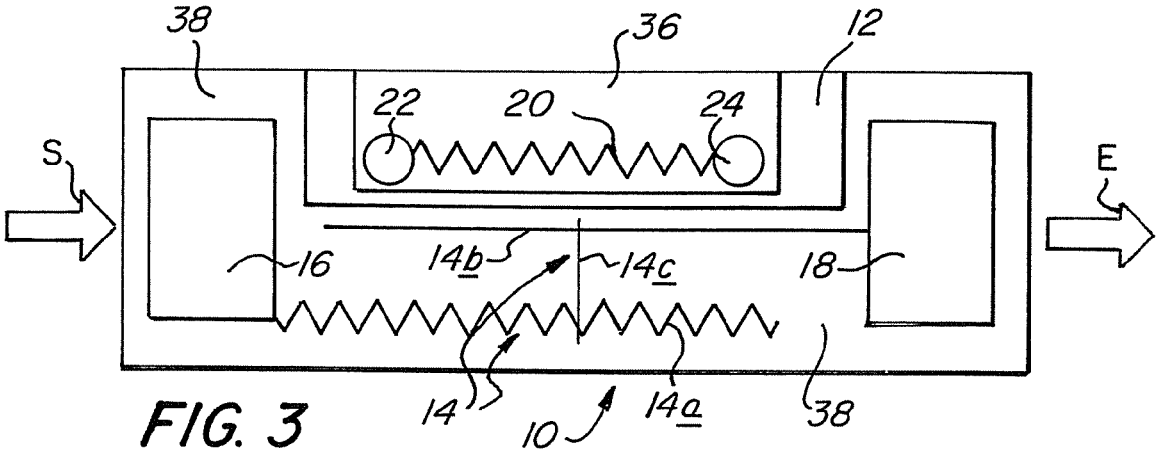
FIG. 3 is a schematic plan view of the delay unit of FIG. 1 with two discrete overlying laminate layers applied to the printed surface thereof.

FIG. 3 shows the delay unit 10 of FIG. 1 to which first reactive layer 36 and second reactive layer 38 have been applied. Reactive layer 36 overlies start flash charge 22, calibration strip 20 and finish flash charge 24. Reactive layer 36 is separated, i.e., is noncontiguous with, reactive layer 38 which overlies pick-up charge 16, relay charge 18 and timing strip 14. This is to prevent ignition of calibration strip 20 from igniting timing strip 14. In some cases, the reactive layer will burn only along the path of the strip, i.e., only that portion of first reactive layer 36 which is in contact with calibration strip 20 (and charges 22 and 24) will burn. In such case, it would not be necessary to segregate first reactive layer 36 from second reactive layer 38. In cases where a coating or laminate layer is not a reactive layer, it is not necessary to segregate the coating layer over calibration strip 20 from the coating layer over timing strip 14.

Figure 4:
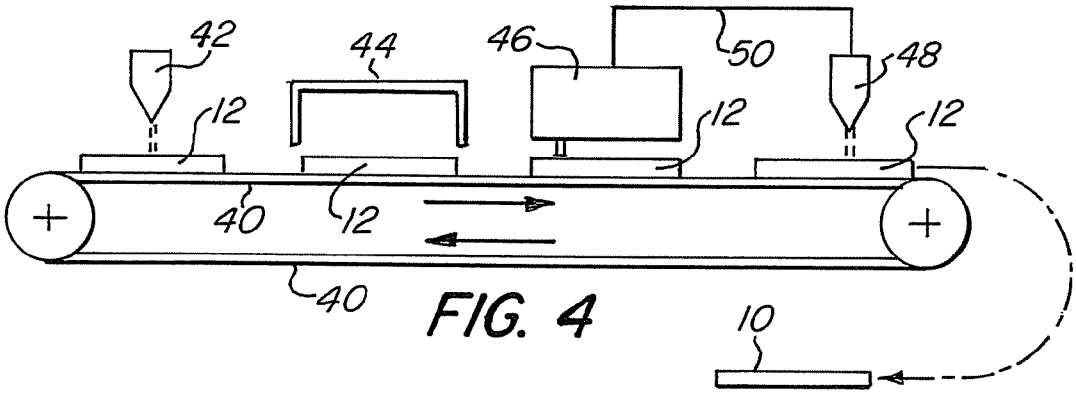
FIG. 4 is a schematic elevation view of one embodiment of a production line for manufacturing a delay unit in accordance with the present invention.
Figure 4A:
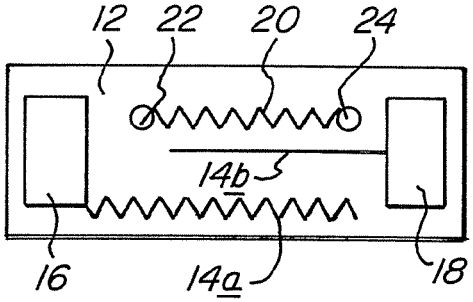
FIGS. 4A, 4B and 4C are schematic plan views, enlarged relative to FIG. 4, showing the delay unit of FIG. 1 in various stages of manufacture.

Referring now to FIG. 4, there is shown schematically a production line for manufacturing the delay units of the invention. An endless conveyer belt 40 carries a plurality of substrates 12 sequentially past a first printing head 42 which applies to substrate 12 a suitable ink of energetic material. The ink may comprise particles of energetic material dispersed in a continuous liquid phase. The continuous liquid phase may be inert or, optionally, may itself comprise an active component of the energetic material. Once applied, the ink dries or hardens to leave behind one or more strips of hardened or dried energetic material adhering to the substrate. First printing head 42 thus applies to the substrate 12 a calibration strip 20, a first strip 14*a* and a second strip 14*b*. A terminal gap is left between strips 14*a* and 14*b*. Calibration strip 20 is applied between calibration start flash charge 22 and calibration finish flash charge 24. One end of first strip 14*a* contacts pick-up charge 16 and one end of second strip 14*b* contacts relay charge 18. Charges 16, 18, 22 and 24 were applied to substrate 12 prior to substrate 12 being passed beneath first printing head 42. However, charges 16, 18, 22 and 24, or some of them, could be applied subsequent to passage of substrate 12 under first printing head 42 or substantially simultaneously therewith. FIG. 4A shows substrate 12 as it leaves drying oven 44 and prior to encountering test station 46.

Figure 4B:
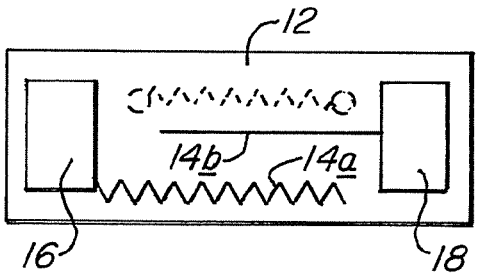
Figure 4C:
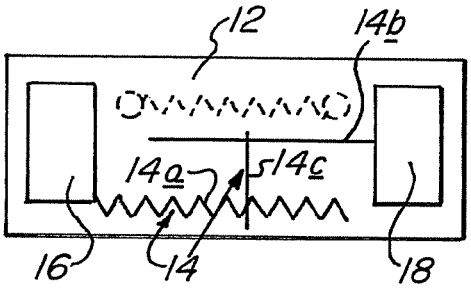

Referring again to FIG. 4, after leaving first printing head 42, substrate 12, with strips 14*a*, 14*b* and 20 printed on the active surface thereof, passes through a drying oven 44 in which the applied strips are thoroughly dried. The now-printed substrate 12 passes beneath test station 46 in which calibration start flash charge 22 is ignited. The length of time required for calibration strip 20 to burn completely and ignite calibration finish flash charge 24 is measured by any suitable means. FIG. 4B shows substrate 12 after ignition of calibration charges 22 and 24 and calibration strip 20, and prior to entry of substrate 12 to second printing head 48. Typically, an optical reader will measure the time between the flash engendered by ignition of calibration start flash charge 22 and calibration finish flash charge 24. That datum is recorded at test station 46 and is utilized to calculate the burn rate of calibration strip 20. Assuming the same burn rate for the effective length of timing strip 14 (FIG. 4C), the required location of intersections (shown as $I_1$ and $I_2$ in FIG. 1) to connect first strip 14*a* to second strip 14*b* is calculated. A line 50 connects test station 46 to second printing head 48 to control the location and pattern of bridging strip 14*c* to be applied by second printing head 48 to bridge the terminal gap between strips 14*a* and 14*b* and to provide an effective length of timing strip 14 (FIG. 4C) to give the desired delay time. Delay unit 10 is discharged from conveyer belt 40 to further processing, or storage, or use.

The practices of the present invention provide the highly advantageous ability to adjust each timing strip to provide a closely controlled accurate and precise burn time and consequent delay period. Such individual adjustment has previously been available only with more expensive electronic delay units. In some circumstances, however, it may be desired to test only representative samples of a given production run by ignition of calibration strip 20. For example, one in ten, one in fifty or one in one hundred of the substrates 12 may be tested by ignition of calibration strip 20. The frequency at which the substrates or delay units are tested will be shown by experience in a given manufacturing operation to provide the required degree of control of the accuracy and precision of the delay units provided by the particular manufacturing process and materials utilized. Naturally, testing of each unit provides the maximum degree of quality control for accuracy and precision of the delay period.

Example 1

The nanosized materials used in this Example are all commercially-available materials supplied by Nanotechnologies Inc. of Austin, Tex. Mixing of the nanosized materials with a liquid was carried out by placing the nanosized materials and the liquid in stainless steel beakers and inserting into the mixture an ultrasonic horn which was operated intermittently with equal duration on-and off periods with the beaker being rotated about the horn. Mixing was conducted for about fourteen minutes while the temperature of the mixture was raised by the ultrasonic mixing from about 19° C. to about 45° C. The mixture was then decanted onto a stainless steel pan to form a thin film on the pan, which was heated at 70° for 1½ hours. The resulting dried material was flaked off the pan with a brush and collected. The collected dried material was then blended into a nitrocellulose lacquer in each case, as follows.

0.18 milliliters (ml) of n-butyl acetate
0.13 ml of nitrocellulose lacquer
0.24 grams of the collected dried material The combined materials were mechanically thoroughly mixed and placed into a plastic syringe filled with a needle tip having a cannula diameter of 0.0052 inch (0.1321 millimeter).

The resulting "ink" was applied through the needle tip onto a clean aluminum plate in straight-line and squiggle (wavy) line patterns. The applied lines were allowed to thoroughly dry, by evaporation of the volatile components of the lacquer.

Sample 1A
Nanosized materials:
0.6 g $MoO_3$ particles of 500 to 1,000 nm diameter
0.4 g Al particles of 80 nm diameter
Liquid: 83.4 g hexane Burn test characteristics of applied lines: Burned very energetically and completely, and essentially without generating smoke.

Sample 1B
Nanosized materials:
0.561 grams of $TiO_2$ particles of 500 to 1,000 nm diameter
0.44 g Al particles of 80 nm diameter
Liquid: 90 g of isopropyl alcohol Burn test characteristics of applied lines: Burned at a much slower rate than the material of Sample 1A, but burned completely and essentially without generating smoke.

Figure 5:
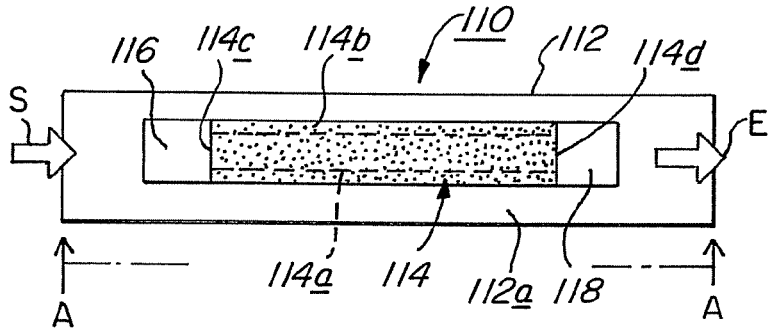
FIG. 5 is a schematic plan view of a delay unit in accordance with a second embodiment of the present invention.
Figure 5A:
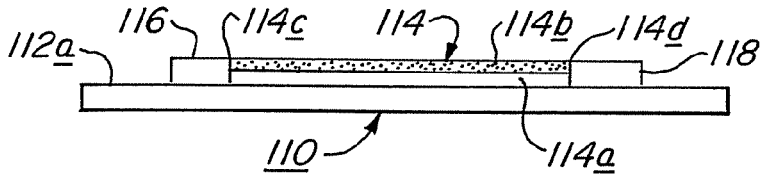
FIG. 5A is a schematic elevation view taken along line A-A of FIG. 5.

Referring to FIGS. 5 and 5A there is schematically shown a delay unit 110 comprising a substrate 112 on which is printed or otherwise applied a timing strip 114 comprised of strips of a fuel layer 114*a* overlain by an oxidizer layer 114*b*. As shown in FIG. 5, oxidizer layer 114*b* is wider than and overlaps fuel layer 114*a*, which is rendered in FIG. 5 in dash outline. While all the accompanying drawings are schematic and not drawn to scale, it will be appreciated that the drawings show a broad range of relatively wide (FIGS. 5-6A) and narrow (FIGS. 11A-11C) timing strips, their component strips (FIGS. 11A-11C) and calibration strips (FIGS. 6 and 11A-11C). However, actual length-to-diameter ratios should not be inferred from the schematic drawings, nor should the terminology "strip" be interpreted to require a thread-like configuration, although such is not excluded. Generally, a small width (and thickness) relative to length is desirable for reducing the amount of energetic material required for a given delay unit, provided that the strips are sufficiently wide and thick to ensure reliable signal propagation.

Timing strip 114 has a starting point 114*c* and a discharge point 114*d*, the distance between those two points defining the "effective length" of timing strip 114. Starting point 114*c* is connected in signal transfer communication to a pick-up charge 116 disposed on substrate 112, and discharge point 114*d* is in signal transfer communication with a relay charge 118 also disposed on substrate 112. Pick-up charge 116 and relay charge 118 may be applied to substrate 112 in a manner similar or identical to that used to print or otherwise apply timing strip 114 to substrate 112. Alternatively, charges 116 and 118 may be applied to substrate 112 by any other suitable means. Charges 116 and 118 may, but need not, be comprised of energetic nanosize materials, or they may be comprised of conventional explosive materials.

Application of fuel layer 114*a* and oxidizer layer 114*b* in separate operations provides an important safety advantage as it avoids the necessity for mixing fuel and oxidizer components into a single ink and then handling the resulting energetic material and applying it to substrate 112. By applying the fuel and oxidizer components separately, a safer and less expensive operation may be employed as compared to handling a pre-mixed reactive composition. Separate application of the fuel and oxidizer obviates the need for certain precautions which are necessary when handling reactive mixtures of fuel and oxidizer. Such precautions include employing explosion barricades, maintaining temperature and humidity conditions which will reduce the likelihood of inadvertent ignition of the reactive mixture, and taking precautions to prevent electrostatic discharge which might ignite the reactive mixture.

Substrate 112 may be made of any suitable material such as conventional printed circuit board, a fiberglass-reinforced plastic, a ceramic, or any suitable material or combination of materials. For example, the substrate may comprise an electrically non-conductive material, or a material having an electrically non-conductive surface layer on which the timing strip 114 and, optionally, a calibration strip (as described below) are printed. Substrate 112 may optionally be made of an energetic material or it may have a coating of energetic material on the surface (sometimes below referred to as "the active surface") upon which the timing strip, optional calibration strip and pick-up and relay charges (described below) are deposited. A "reactive" substrate or coating as used herein means a substrate or coating which participates in the burn reaction of the strip or strips of energetic material. For example, a substrate or coating on active surface 112*a* which supplies oxygen to the burn reaction of the timing strip or calibration strip, such as an oxygen-containing metal compound, e.g., potassium nitrate, would be a reactive substrate or coating.

Substrate 112 may, of course, be of any size suitable for the intended use of the delay unit. For a delay unit which is intended for use in a standard size detonator shell, as described below, substrate 112 would typically have a width selected to approximate the inside diameter of the detonator shell so as to fit snugly therein. A mounting frame (not shown in the drawings) sized to snugly fit within the detonator shell may optionally be utilized and the substrate 112 would then be sized to fit the mounting frame. Substrate 112 would have a length of from about one-quarter inch (0.64 cm) to about 1.2 inches (3.05 cm) to easily fit within a standard size detonator shell. Substrate 112, which may be made of conventional printed circuit board, need be only thick enough to provide sufficient rigidity and mechanical strength to be manipulated during manufacture and installation in an explosive device without physical distortion of the strips on the active surface. For example, substrate 112 may be from about 1/16 to 1/8 inch (0.159 to 0.318 cm) thick. Arrows S and E in FIGS. 5 and 6 are described below.

Delay unit 110 may be manufactured by the following method. A suitable substrate 112 has printed (or otherwise applied) thereon timing strip 114. Pick-up charge 116 and relay charge 118 are applied to the active surface 112*a* of substrate 112 by any suitable means. After the applied timing strip 114 and charges 116, 118 dry, any desired post-printing treatment or processing of delay unit 110, such as the optional application of a lacquer, a laminate or other coating to the active surface 112*a*, may be carried out. Alternatively, or in addition, a potting compound may be used to enclose the timing strip 114 or portions thereof, and/or charges 116 and 118. The optional laminate or coating may be inert to the burn reaction or it may comprise an oxidizer or a fuel or both which participate in the burn reaction of the timing strip 114.

Figure 6:
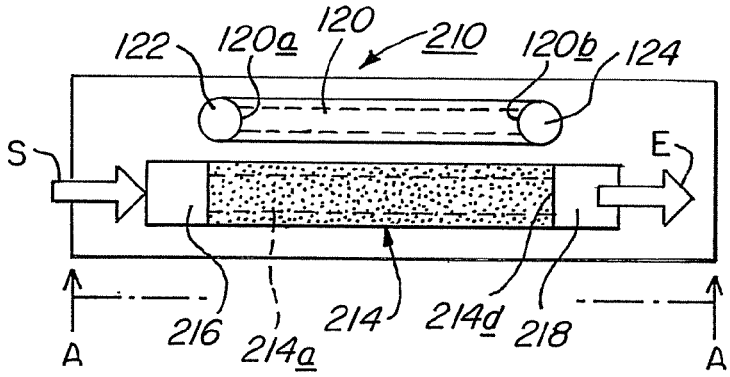
FIG. 6 is a schematic plan view of a delay unit in accordance with a third embodiment of the present invention.
Figure 6A:
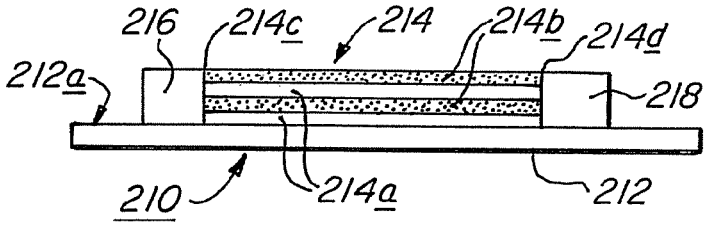
FIG. 6A is a schematic elevation view taken along line A-A of FIG. 6.

Referring now to FIGS. 6 and 6A, there is shown a delay unit 210 comprised of a substrate 212 on which is disposed a timing strip 214 comprised of alternating fuel layers 214*a* and oxidizer layers 214*b*. Timing strip 214 has a starting point 214*c* and a discharge point 214*d*. A pick-up charge 216 is disposed in signal transfer communication with starting point 214*c* and a relay charge 218 is disposed in signal transfer communication with discharge point 214*d*. Substrate 212 has an active surface 212*a*.

Also disposed on active surface 212*a* is a calibration strip 120 which itself is comprised of a plurality of fuel layers 214*a* and oxidizer layers 214*b* arranged identically to the alternating fuel and oxidizer layers 214*a* and 214*b* of timing strip 214. Consequently, calibration strip 120 is of similar, preferably identical, composition and structure as timing strip 214, except that calibration strip 120 may, of course, have an effective length which is shorter or longer than the effective length of timing strip 214 without any disadvantage. Preferably, the alternating layers of calibration strip 120 are applied from the same batches of inks as are the layers of timing strip 214 and, preferably, the layers of calibration strip 120 are applied at the same time and under the same conditions as those of timing strip 214. Calibration strip 120 has a calibration starting point 120*a* and a calibration discharge point 120*b*, which points are in signal transfer contact with, respectively, start flash charge 122 and finish flash charge 124. While calibration strip 120 is illustrated as being applied to the same substrate 212 as timing strip 214, it may be applied to a separate substrate (not shown) to prepare a test piece for testing as described below. The separate test piece substrate is preferably of similar or identical composition as substrate 212.

Starting point 214*c* of timing strip 214 is in signal transfer communication with pick-up charge 216 and discharge point 214*d* of timing strip 214 is in signal transfer communication with relay charge 218. Calibration strip 120 and its associated flash charges 122, 124 are separated from timing strip 214 and its associated charges 216, 218 so that ignition of calibration strip 120 and its associated charges will not ignite timing strip 214 and its associated charges.

Delay unit 210 (or a separate test piece, not shown, having calibration strip 120 and its associated charges 122, 124 thereon) may be subjected to testing in a test unit. The test unit ignites start flash charge 122 and takes an accurate reading of the time period required for calibration strip 120 to burn and ignite finish flash charge 124. This may be accomplished by any suitable measuring device. The time period required for calibration strip 120 to burn from charge 122 to charge 124 is, for example, readily read electronically by measuring the time delay between the two flashes engendered by charges 122 and 124. That measured time interval and the known length of calibration strip 120 enables ready calculation of the burn rate (distance per unit time, e.g., centimeters per second) of calibration strip 120. The burn rate of calibration strip 120 will be substantially identical to the burn rate of timing strip 214 because timing strip 214 is preferably printed from the same or identical batches of energetic material component inks as calibration strip 120 and, preferably, during the same manufacturing operation and under the same printing conditions. Preferably, the timing and calibration strips are of identical thickness, width and configuration of layers and are disposed on the same substrate or on identical substrate material. All this is to promote burning of the timing strip 214 and calibration strip 120 at substantially identical rates.

Once the burn rate, i.e., the speed of travel of the signal along calibration strip 120, is known, the effective length of timing strip 214 required for a desired delay period is determined on the basis that timing strip 214 has the same burn rate as calibration strip 120. Calibration strip 120 may thus be utilized as a quality control check if timing strip 214 has already been applied to substrate 212. In other instances, calibration strip 120 may be used to determine the length of timing strip 214. As noted above, each or only selected ones of the delay units being manufactured, may be tested to assure maintaining the time delay period within desired limits. As also noted above, charges 216, 218 may be applied onto a pre-existing timing strip 214 which is made somewhat longer than required for the desired time delay period. Charges 216 and 218 are placed on timing strip 214 at a selected distance from each other to provide an effective length of timing strip 214 uncovered by and between charges 216 and 218 which, based on the burn rate determined by use of calibration strip 120, will give the desired delay period.

The timing strips 114, 214 and the calibration strips 120 may be applied to substrates 112, 212 by any suitable printing or deposition technique such as those used in the printing and graphics industries. These include, by way of illustration and not limitation, silk screening, ink-jet printing, stenciling, transfer printing and other such techniques.

Figure 7:
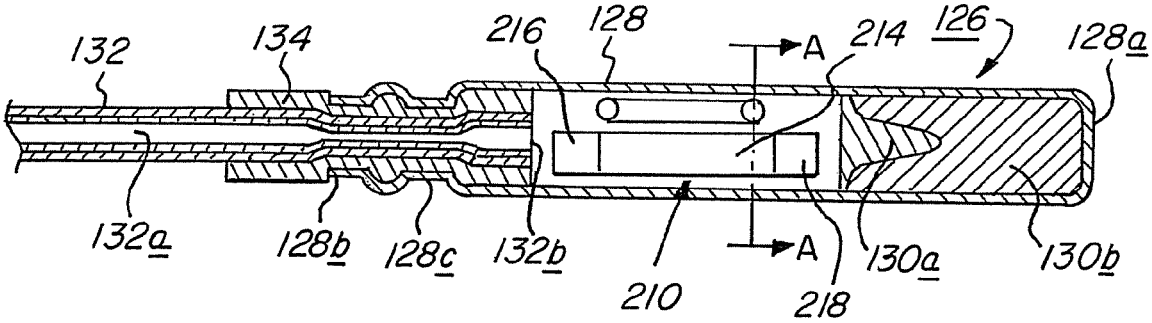
FIG. 7 is a schematic cross-sectional longitudinal view of a delay detonator equipped with the delay unit of FIG. 6.

The delay unit of the present invention may be inserted within a conventional detonator shell 128 (FIGS. 7 and 7A) and configured to leave a substantial volume of free space 129*a*, 129*b* on either side of delay unit 110 within shell 128, as shown in FIG. 7A. The inside diameter D (FIG. 7A) of a conventional detonator shell 128 is about 0.256 inch (0.650 cm).

A delay unit as described above may be encapsulated within any suitable encapsulation material, such as a potting compound of the type typically used to encase electronic components. The encapsulating material may be configured to provide a suitable shape and size for a desired purpose. For example, if the delay unit is intended for use within a delay detonator of conventional size, the encapsulating material is formed as a cylinder of circular cross section whose outside diameter snugly fits within the inside diameter of a standard detonator shell. Suitable passageways are formed within the encapsulating material in order to permit input and output signals from the delay unit.

Alternatively, the encapsulating material may comprise simply a layer or laminate of any suitable non-reactive material deposited over the top of the timing strip; this layer may be deposited by spraying, roll application, painting, printing, application of a laminate sheet or other suitable techniques for applying such laminate coatings.

Encapsulation of the delay unit can serve several purposes, including isolating the timing strip from environmental effects such as the pressure pulse from a shock tube (which may affect the burn speed of the timing strip), enabling the delay fuze element consisting of the timing strip on the substrate to conform to the shape of a container or package such as a standard detonator shell, and preventing short-circuiting or flashing over by the delay fuze component by the end spit (the flame pulse signal) from a shock tube.

FIG. 7B is a perspective view of a cylindrical-shaped embedment 158 within which a delay unit 710 is embedded. Delay unit 710 is similar to the delay unit 210 illustrated in FIG. 6 and comprises a substrate 712 on which is disposed a calibration strip 720, which connects a calibration start flash charge 722 to a calibration finish flash charge 724. A timing strip 714 connects pick-up charge 716 and a relay charge 718. Calibration strip 720 may have been utilized for test control purposes as described above, or it may simply be covered, unused, by embedment 158 (or embedment 158' illustrated in FIG. 7E). If calibration strip 720 has not previously been used, it is obviously of no use once delay unit 710 has been encapsulated within embedment 158 or 158'. Delay units of the invention may, of course, be manufactured without the calibration strip thereon in cases where calibration is not deemed necessary or where calibration is carried out on substrates separate and apart from the substrate utilized in the delay unit.

Cylindrical embedment 158 has an inlet passage 160 formed at inlet end 158*a* thereof and an outlet passage 162 formed at outlet end 158*b* thereof. Inlet passage 162 extends longitudinally along embedment 158 sufficiently far to expose pick-up charge 716 to an input signal indicated by the arrow S. Outlet passage 162 extends longitudinally along embedment 158 from outlet end 158*b* thereof sufficiently far that the signal generated by relay charge 718 will emerge from embedment 158 as indicated by the arrow E.

Embedment 158 may be substituted for delay unit 210 in the detonator illustrated in FIG. 7 and such substitution is illustrated in FIGS. 7C and 7D. Such an arrangement will function in substantially the same manner as the embodiment of FIG. 7, but timing strip 714 will be shielded from the pressure build-up taking place within shock tube 132 of FIG. 7. If shock tube 132 is of sufficiently long length, reaction of the energetic material disposed on the interior wall 132*a* thereof will cause a pressure build-up high enough to affect the burn rate of timing strip 714. By encapsulating timing strip 714, it is protected from changes in pressure and therefore its burn rate is unaffected even by significant pressure changes.

The cylindrical configuration of embedment 158 is dimensioned to have an outside diameter d (FIG. 7B) which will snugly fit within the inside diameter D (FIG. 7D) of detonator shell 128. This facilitates the manufacturing process because cylindrical-shaped embedment 158 is more readily inserted into the interior of shell 128 than would be an unembedded delay unit such as those illustrated in FIGS. 6, 6A and 7A. (Obviously, insertion of the delay unit and other components takes place before the crimps 128*c* (FIG. 6) are formed to retain shock tube 132 in place.) Embedment 158 also increases the mechanical strength of delay unit 710 and protects it during handling in the manufacturing process and during shipment if it is shipped prior to insertion of it into an explosive device.

As seen in FIGS. 7C and 7D, embedment 158 fits snugly within detonator shell 128 and (FIG. 7) bushing 134 retains and positions shock tube 132 within detonator shell 128. Inlet passage 160 of embedment 158 is aligned with the interior of shock tube 132 (and with pick-up charge 716). Outlet passage 162 of embedment 158 is aligned with relay charge 718 and with detonator output charge 130, more specifically, with lead azide initiating charge 130*a* thereof, which is interposed between PETN main charge 130*b* and the output signal represented by arrow E.

While, as noted above, a cylindrical configuration of embedment 158 is well suited for use within a cylindrical detonator shell such as shell 128, the embedment obviously may take other suitable shapes, whether for use in circular or non-circular cross section devices. Even when used within detonator shell 128, as shown in FIG. 7E, the embedment need not necessarily have a circular cylindrical shape, but may, for example, comprise a layer embedment 158' covering timing strip 714, leaving free spaces 129*a* and 129*b* within detonator shell 128 on either side of delay unit 712. Inlet and outlet passages (not shown in FIG. 7E) corresponding to inlet and outlet passages 160, 162 shown in FIGS. 7B and 7C, are also provided in layer embedment 158'. Embedment material may also be applied to the underside of substrate 712 as viewed in FIG. 7E to provide a thicker embedment of delay unit 710 to increase its mechanical strength and to facilitate insertion into detonator shell 128.

The most common fuels for nanoenergetic materials used in the delay units of the present invention are Al, Cu and Ag, primarily for the reasons that they are highly conductive, are relatively cheap, have proven to be safe to work with as "nanosize" (about 20 to about 1,500 nm) diameter particles, and offer good performance. Generally, fuel and oxidant reactant pairs useful in nanosize particles for applying timing and calibration strips in accordance with the teachings of the present invention are M'+MxOy, where M' is a suitable metal fuel and M is a suitable metal different from M' and in oxide form, and x and y are positive integers, e.g., 1, 2, 3 . . . n, which may be the same or different. Both M' and MxOy must be capable of being reduced to nanosize particles. Suitable metal fuels in nanosize particles in accordance with the practices of the present invention include Ag, Al, B, Cu, Hf, Si, Sn, Ta, W, Y and Zr. Known nanosize thermites include the following stoichiometric fuel and oxidant reactant pairs, which are taken from those listed in Table 1a of the above-described paper *Theoretical Energy Release of Thermites, Intermetallics and Combustible Metals* ("the Sandia Paper"). The following specific reactant pairs are believed to be suitable for the practices of the present invention. Stoichiometric ratios of the fuel and oxide are shown; the practices of the present invention may, but need not, employ stoichiometric ratios of the fuel and oxidizer.

$2Al+3AgO$; $2Al+3Ag_2O$; $2Al+B_2O_3$; $2Al+Bi_2O_3$; $2Al+3CoO$; $8Al+3Co_3O_4$; $2Al+Cr_2O_3$; $2Al+3CuO$; $2Al+3Cu_2O$; $2Al+Fe_2O_3$; $8Al+3Fe_3O_4$; $2Al+3HgO$; $10Al+3I_2O_5$; $4Al+3MnO_2$; $2Al+MoO_3$; $10Al+3Nb_2O_5$; $2Al+3NiO$; $2Al+Ni_2O_3$; $2Al+3PbO$; $4Al+3PbO_2$; $8Al+3Pb_3O_4$; $2Al+3PdO$; $4Al+3SiO_2$; $2Al+3SnO$; $4Al+3SnO_2$; $10Al+3Ta_2O_5$; $4Al+3TiO_2$; $16Al+3U_3O_8$; $10Al+3V_2O_5$; $4Al+3WO_2$; $2Al+WO_3$; $2B+Cr_2O_3$; $2B+3CuO$; $2B+Fe_2O_3$; $8B+3Fe_3O_4$; $4B+3MnO_2$; $8B+3Pb_3O_4$; $3Hf+2B_2O_3$; $3Hf+2Cr_2O_3$; $Hf+2CuO$; $3Hf+2Fe_2O_3$; $2Hf+Fe_3O_4$; $Hf+MnO_2$; $2Hf+Pb_3O_4$; $Hf+SiO_2$; $2La+3AgO$; $2La+3CuO$; $2La+Fe_2O_3$; $2La+3HgO$; $10La+3I_2O_5$; $4La+3MnO_2$; $2La+3PbO$; $4La+3PbO_2$; $8La+3Pb_3O_4$; $2La+3PdO$; $4La+3WO_2$; $2La+WO_3$; $3Mg+B_2O_3$; $3Mg+Cr_2O_3$; $Mg+CuO$; $3Mg+Fe_2O_3$; $4Mg+Fe_3O_4$; $2Mg+MnO_2$; $4Mg+Pb_3O_4$; $2Mg+SiO_2$; $2Nd+3AgO$; $2Nd+3CuO$; $2Nd+3HgO$; $10Nd+3I_2O_5$; $4Nd+3MnO_2$; $4Nd+3PbO_2$; $8Nd+3Pb_3O_4$; $2Nd+3PdO$; $4Nd+3WO_2$; $2Nd+WO_3$; $2Ta+5AgO$; $2Ta+5CuO$; $6Ta+5Fe_2O_3$; $2Ta+5HgO$; $2Ta+I_2O_5$; $2Ta+5PbO$; $4Ta+5PbO_2$; $8Ta+5Pb_3O_4$; $2Ta+5PdO$; $4Ta+5WO_2$; $6Ta+5WO_3$; $3Th+2B_2O_3$; $3Th+Cr_2O_3$; $Th+2CuO$; $3Th+2Fe_2O_3$; $2Th+Fe_3O_4$; $Th+MnO_2$; $Th+PbO_2$; $2Th+Pb_3O_4$; $Th+SiO_2$; $3Ti+2B_2O_3$; $3Ti+2Cr_2O_3$; $Ti+2CuO$; $3Ti+2Fe_2O_3$; $Ti+Fe_3O_4$; $Ti+MnO_2$; $2Ti+Pb_3O_4$; $Ti+SiO_2$; $2Y+3CuO$; $8Y+3Fe_3O_4$; $10Y+3I_2O_5$; $4Y+3MnO_2$; $2Y+MoO_3$; $2Y+Ni_2O_3$; $4Y+3PbO_2$; $2Y+3PdO$; $4Y+3SnO_2$; $10Y+3Ta_2O_5$; $10Y+3V_2O_5$; $2Y+WO_3$; $3Zr+2B_2O_3$; $3Zr+2Cr_2O_3$; $Zr+2CuO$; $3Zr+2Fe_2O_3$; $2Zr+Fe_3O_4$; $Zr+MnO_2$; $2Zr+Pb_3O_4$; and $Zr+SiO_2$.

The following metal oxides taken from Table 3a of the Sandia Paper are believed to be suitable in nanosize particles for use as oxidizers in the practices of the present invention.

$Ag_2O$; $Al_2O_3$; $B_2O_3$; $BeO$; $Bi_2O_3$; $Ce_2O_3$; $CoO$; $Cr_2O_3$; $Cs_2O$; $Cs_2O_3$; $CsO_2$; $CuO$; $Cu_2O$; $Fe_2O_3$; $Fe_3O_4$; $HfO_2$; $La_2O_3$; $Li_2O$; $MgO$; $Mn_3O_4$; $MoO_3$; $Nb_2O_5$; $Nd_2O_3$; $NiO$; $Pb_3O_4$; $PdO$; $Pt_3O_4$; $SiO_2$; $SnO_2$; $SrO_2$; $Ta_2O_5$; $ThO_2$; $TiO_2$; $U_3O_8$; $V_2O_5$; $WO_2$; $WO_3$; $Y_2O_3$; $ZnO$; and $ZrO_2$.

In addition to the above known metal and metal oxide fuel and oxidizer reactant pairs, $TiO_2$, not heretofore known as a suitable oxidizer for nanosize particle thermite compositions, works well in the practices of the present invention, especially when used in combination with Al as the metal fuel.

In those cases in which the oxidizer and fuel components are maintained separately from each other and applied to the substrate separately, the application is carried out in a manner which places the separately applied fuel and oxide layers into contact with each other on the substrate. Contact may be abutting contact, peripherally overlapping contact or fully overlying contact, i.e., one layer applied over and fully covering another. Two or more alternating layers of fuel and oxidizer materials, e.g., nanosized fuel and oxidizer materials in both the fuel and oxidizer layers, may be employed. As described elsewhere herein, gaps may be provided in the energetic material to increase the burn time in a particular case.

The order of application of the fuel and oxidizer layers to the substrate is not critical, i.e., the oxidizer layer may be the first layer deposited and the fuel layer may be deposited over the oxidizer layer.

FIG. 7 shows a schematic rendition of the delay unit 210 of FIGS. 6 and 6A incorporated into an otherwise conventional detonator 126. Detonator 126 comprises a conventional shell 128 having a closed end 128*a* and an open end 128*b*. An explosive charge, for example, a conventional detonator output charge 130 having a lead azide initiating charge 130*a* and a PETN main charge 130*b*, is contained within the shell 128 at closed end 128*a*. Detonator 126 receives at its open end 128*b* a signal transmission fuse comprising, in the illustrated embodiment, shock tube 132 which contains an energetic material (not shown) coated on its interior wall 132*a*. Bushing 134 is positioned to seal open end 128*b* and is retained in place by a crimp 128*c* formed in the shell 128 to seal the interior of the shell 128 from the environment, and to position and hold shock tube 132 in place, as is well-known in the art. In lieu of a conventional pyrotechnic delay interposed between the output end 132*b* of shock tube 132 and detonator output charge 130, there is provided the delay unit 210 of FIGS. 5 and 5A. Conventional components of the detonator 126, such as an isolation cup to prevent inadvertent discharge by static electricity, cushion discs, wiper rings, etc., are omitted from the schematic rendition of FIG. 7 inasmuch as such expedients are well-known to those skilled in art and form no part of the present invention.

As is well-known to those skilled in the art, an initiation device (not shown) ignites the energetic material contained within shock tube 132. The resulting input signal, represented in FIG. 6 (and in FIG. 7C) by arrow S, travels through shock tube 132 and initiates pick-up charge 216 of delay unit 210, which in turn ignites timing strip 214 at the starting point 214*c* thereof. Timing strip 214 burns along its length and after a time the burning reaches discharge point 214*d*, relay charge 218 is ignited and the resulting output energy signal, represented in FIG. 6 (and in FIG. 7C) by arrow E, ignites initiating charge 130*a*, which in turn ignites main charge 130*b* of detonator output charge 130, thereby providing the output explosive energy of detonator 126. The same sequence is attained by using any of the other illustrated delay units 110, 310, 410, 510, 610 or 710 in detonator 126 and so the description need not be repeated with respect to it save to note that FIGS. 5 and 7C also show by arrow S an input signal and by arrow E the resulting output energy.

Figure 8:
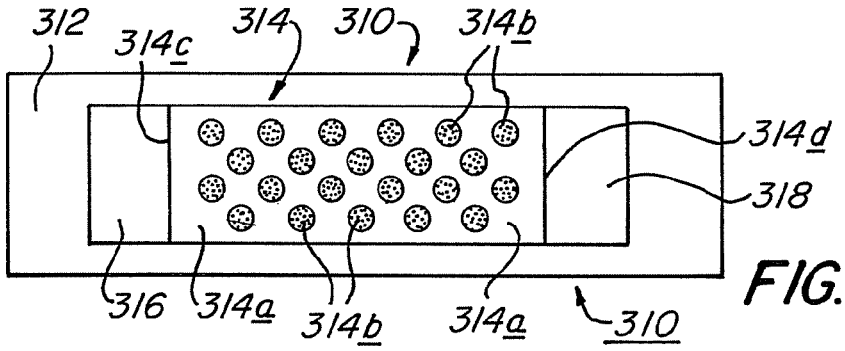
FIG. 8 is a schematic plan view of a delay unit in accordance with a fourth embodiment of the present invention.
Figure 9A:
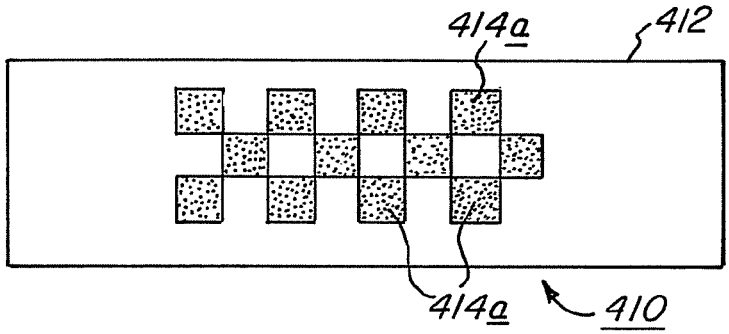
FIG. 9A is a schematic plan view of a delay unit in accordance with a fifth embodiment of the present invention in an intermediate stage of manufacture.
Figure 9B:
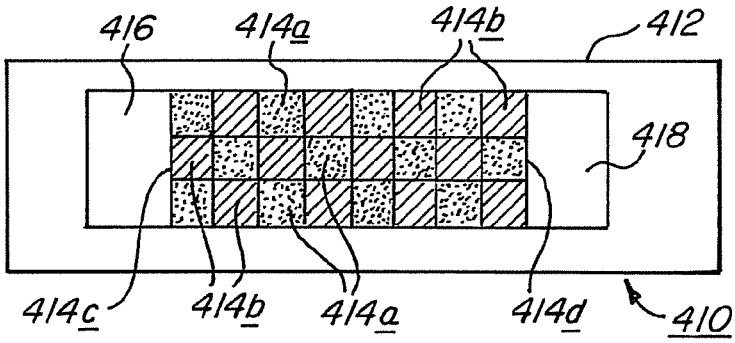
FIG. 9B is a schematic plan view of the delay unit of FIG. 9A in a later stage of manufacture.

The oxidizer and fuel components of the energetic material may be separately applied to the substrate in a pattern which places the separately applied coatings of oxidizer and fuel in contact with each other on the substrate. Thus, FIG. 8 shows an embodiment of the present invention comprising a delay unit 310 comprised of a substrate 312 on which is deposited in a rectangular pattern timing strip 314 comprised of a fuel layer 314*a* over which is applied, in a polka dot pattern, a plurality of oxidizer layers 314*b*. Alternatively, fuel layer 314*a* may have "holes" in it which are filled by the oxidizer polka dots, with the oxidizer polka dots and the fuel layer overlapping each other. The purpose of such patterns of fuel and oxidizer, including those illustrated in FIGS. 9A and 9B, is to control the burn rate of timing strip 314 either to attain a predetermined burn time or to modify the burn time as a result of data developed by functioning the calibration strip. The spaces between the applied polka dots of oxidizer layers 314*b* effectively provide "jump gaps" in the timing train. Such jump gaps are small enough that they do not terminate the burn reaction but slow it up by requiring the reaction to jump over places (jump gaps) where there is no oxidizer or no fuel. These patterned applications thus provide jump gaps which function in a manner similar to that of jump gaps 164 illustrated in FIG. 12, in which the gaps 164 contain neither oxidizer nor fuel, as described below. A pick-up charge 316 is in signal transfer contact with timing strip 314 at starting point 314*c* thereof and a relay charge 318 is in signal transfer contact with timing strip 314 at discharge point 314*d* thereof. The rendition of FIG. 8 is schematic and, obviously, more or fewer and larger or smaller "polka dot" circles of oxidizer material may be applied over fuel layer 314*a*. Further, as in all embodiments, alternating fuel and oxidizer layers may be applied. Thus, a second fuel layer (not shown) could be applied over the polka dot oxidizer layer, a second polka dot oxidizer layer (not shown) could be applied over the second fuel layer, etc.

FIGS. 9A and 9B show stages in the manufacture of a delay unit 410 in which (FIG. 9A) a fuel layer 414*a* is applied to substrate 412 in a checkerboard pattern and an oxidizer layer 414*b* (FIG. 9B) is applied over the checkerboard pattern to cover the vacant squares of the checkerboard pattern of the fuel layer. Preferably, one or both of the squares of fuel layer 414*a* and oxidizer layer 414*b* will be made oversize so that adjacent squares of fuel and oxidizer overlap at edges of the squares to insure that the fuel and oxidizer layers make good contact with each other. As seen in FIG. 9B, pick-up charge 416 and relay charge 418 are positioned in signal transfer contact with, respectively, starting point 414*c* and discharge point 414*d* of timing strip 414.

Figure 10:
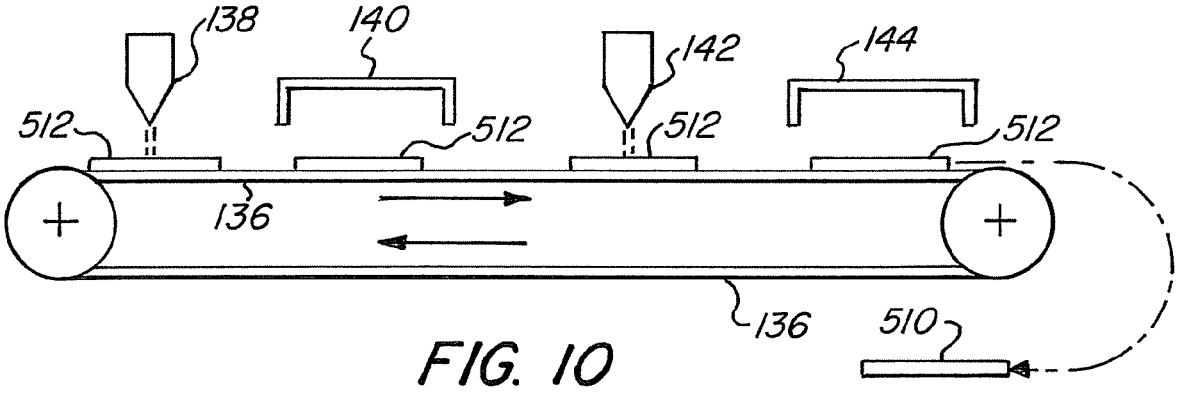
FIG. 10 is a schematic elevation view of one embodiment of a production line for manufacturing a delay unit in accordance with a first method of the present invention.

Referring now to FIG. 10, there is shown schematically in elevation one embodiment of a production line for manufacturing the delay units of the present invention. An endless conveyer belt 136 carries a plurality of substrates 512 sequentially past a first printing head 138 which applies to substrate 512 in a suitable pattern a fuel layer (not shown in FIG. 10). After leaving first printing head 138, substrate 512 with a fuel layer applied thereto, passes through a first drying oven 140 in which the applied fuel layer is thoroughly dried. Substrate 512 then passes beneath second printing head 142 which applies a layer of oxidizer material (not shown in FIG. 10) in a suitable pattern which contacts the previously applied fuel layer. The substrate 512 then passes through second drying oven 144 in which the applied oxidizer layer is thoroughly dried. If multiple layers of fuel and oxidizer layers are to be applied, the process may be repeated as many times as needed or the conveyer belt may be lengthened to accommodate additional printing heads and drying ovens. In some cases, both the fuel and oxidizer layer may be applied prior to drying. The finished delay unit 510 is then removed from the conveyer belt.

The present invention enjoys significant advantages over conventional pyrotechnic delay units. For one, the printed or otherwise deposited strips of the present invention require a much smaller quantity of energetic material as compared to the quantity of pyrotechnic material required for a conventional pyrotechnic-filled metal tube providing the same delay period. The significant reduction in the quantity of energetic material attainable with the present invention not only reduces material costs, but ameliorates or overcomes the problem of gassing. The formation of the gaseous products of combustion of the energetic material of a delay unit creates a pressure within the delay unit or its enclosure, which pressure increase affects the burn rate, thereby adversely affecting accuracy and reliability in attaining the desired delay time. The use of very small quantities of energetic materials in the practices of the present invention as compared to conventional pyrotechnic delay tubes drastically reduces the amount of gaseous reaction products, even if a gas-generating pyrotechnic composition is used as the nanoenergetic material. Further, the present invention also includes the use of thermite materials as the nanopyrotechnic material, and thermite materials do not generate significant (or any) gaseous products of combustion.

The present invention also provides the option of providing and utilizing a calibration strip on the substrate to further enhance the accuracy of delay times provided by timing strip 114. Despite taking the greatest care in preparing energetic materials, including fuel and oxidizer inks as contemplated by the present invention, variations nonetheless occur from batch to batch. The provision of a calibration strip which is substantially identical to all or part of the timing strip, and use of the calibration strip during the manufacturing process to time the burn rate along the calibration strip and configure the timing strip accordingly, enables extremely close control and reproducibility of a desired delay period. This advantage is not available to conventional pyrotechnic delays and manufacturing techniques.

Figure 11:
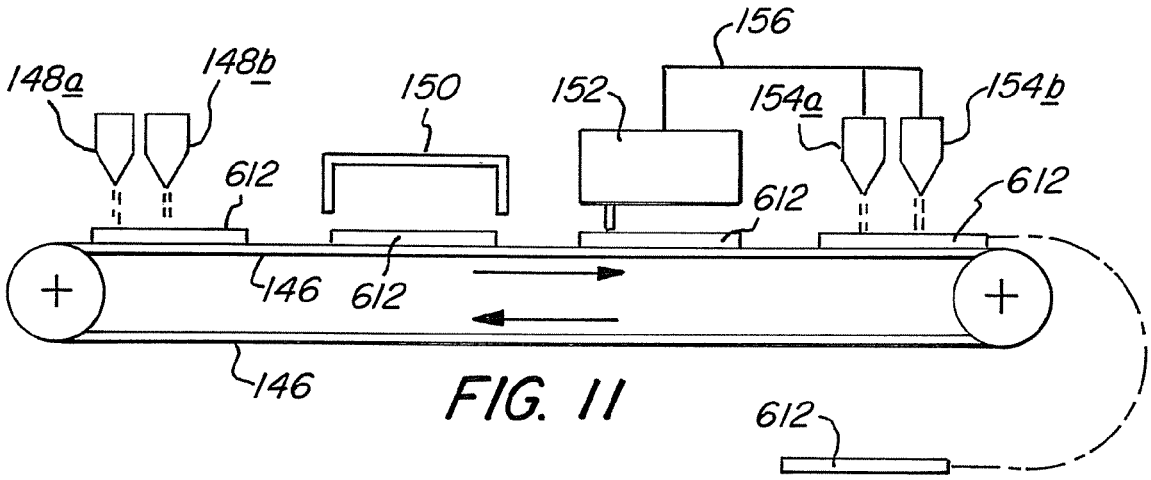
FIG. 11 is a schematic elevation view of another embodiment of a production line for manufacturing a delay unit in accordance with a second method of the present invention.
Figure 11A:
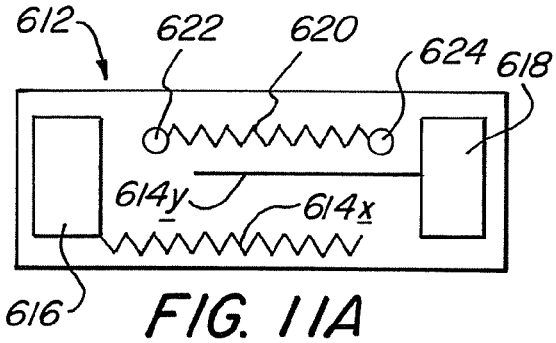
FIGS. 11A, 11B and 11C are schematic plan views, enlarged relative to FIG. 11, showing a sixth embodiment of a delay unit of the present invention in various stages of manufacture in the production line of FIG. 11.
Figure 11B:
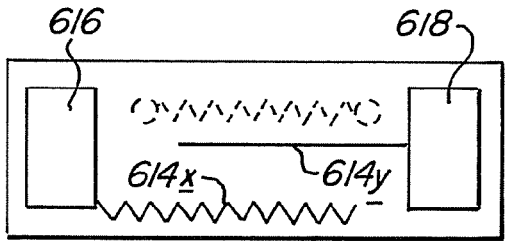
Figure 11C:
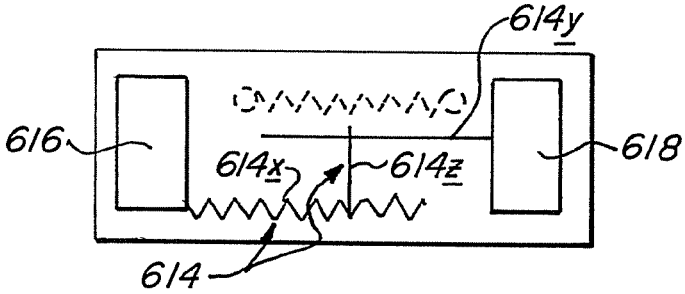

Referring now to FIGS. 11 and 11A-11C, there is shown schematically another embodiment of a production line for manufacturing an embodiment of the delay units of the invention and the resulting product. The embodiment of FIGS. 11A-11C illustrates a manufacturing method of the invention in which a bridging strip is applied to the substrate at a selected location and configuration, to close a discontinuity, i.e., a terminal gap, introduced into an initially-applied portion of the timing strip and provide a selected effective length to the timing strip. An endless conveyer belt 146 carries a plurality of substrates 612 sequentially past a first pair of printing heads 148*a*, 148*b* which applies to substrate 612 a calibration strip 620 and a partial timing strip 614 (FIG. 11C) comprised of a first strip 614*x* and a second strip 614*y*. Printing head 148*a* contains the fuel component, e.g., an ink containing fuel particles, and printing head 148*b* contains the oxidizer component, e.g., an ink containing oxidizer particles. The fuel and oxidizer components may be separately processed, stored and applied, thereby avoiding the necessity of processing, storing and applying a dangerous reactive mixture of fuel and oxidizer. In accordance with this practice, the fuel and oxidizer components contact each other only in the course of, or, preferably, after, being applied to the substrate. Calibration strip 620 is applied between calibration start flash charge 622 and calibration finish flash charge 624. One end of first strip 614*x* contacts pick-up charge 616 and one end of second strip 614*y* contacts relay charge 618. One or more of charges 616, 618, 622 and 624 may be applied to substrate 612 either prior to, after, or simultaneously with substrate 612 being passed beneath the first pair of printing heads 148*a*, 148*b*.

In the illustrated embodiment, first strip 614*x* is of saw-tooth configuration in order to increase its effective length and, thereby, its burn time whereas strip 614*y* is straight. The calibration strip 620 (FIG. 11A) is similarly of saw-tooth configuration and extends between a start flash charge 622 and a finish flash charge 624. By ignition of start flash charge 622 the burn rate of calibration strip 620, and thereby of timing strip 614, can be calculated to determine the total length of timing strip 614 which is required for a desired delay period. This will determine the required configuration and placement of a bridging strip 614*z* which will yield the desired delay period.

As with the other embodiments, calibration strip 620 and timing strip 614 are applied in separate steps to apply the fuel and oxidizer components of calibration strips 620 and the strips of timing strip 614 separately. Calibration strip 620 and timing strip 614 are preferably made of identical materials and configured identically with respect to the number and order of layers of fuel and oxidizer in order that their respective burn rates be substantially identical.

After leaving the first pair of printing heads 148*a*, 148*b*, substrate 612, with strips 614*x*, 614*y* and 620 applied, e.g., printed, on the active surface 612*a* thereof, passes through a drying oven 150 in which the applied strips are thoroughly dried. FIG. 11A shows substrate 612 as it leaves drying oven 150 and prior to encountering test station 152. The now-printed substrate 612 passes beneath test station 152 in which calibration start flash charge 622 of at least some of the substrates 612 is ignited. The length of time required for calibration strip 620 to burn completely and ignite calibration finish flash charge 624 is measured by any suitable means. FIG. 11B shows substrate 612 after ignition of calibration charges 622 and 624 and calibration strip 620, and prior to entry of substrate 612 to a second pair of printing heads 154*a*, 154*b*.

Typically, an optical reader will measure the time between the flash engendered by ignition of calibration start flash charge 622 and calibration finish flash charge 624. That datum is recorded at test station 152. The recorded datum is utilized to calculate the burn rate of calibration strip 620 and, assuming the same burn rate for the effective length of timing strip 614 (FIG. 11C), the required location and configuration of bridging strip 614*z* is calculated. A line 156 connects test station 152 to the second pair of printing heads 154*a*, 154*b* to control the location and pattern of bridging strip 614*z* to be applied by the second pair of printing heads 154*a*, 154*b*, to provide an effective length of timing strip 614 (FIG. 11C) to give the desired delay time. Printing head 154*a* contains the oxidizer component and printing head 154*b* contains the fuel component to keep these components separate until applied to the substrate, as is the case with printing heads 148*a*, 148*b*. Delay unit 610 is discharged from conveyer belt 146 to further processing, or storage, or use.

As noted above, not every one of the delay units has to be tested by ignition of its associated or test calibration strip. For example, one in ten, one in fifty or one in one hundred of the delay units may be tested by ignition of an associated or test calibration strip. The frequency at which the substrates or delay units are tested will be shown by experience in a given manufacturing operation to provide the required degree of control of the accuracy of the delay units provided by the particular manufacturing process and materials utilized.

In some embodiments of the present invention, the timing strip is interrupted, that is, gaps are provided in it, in order to modify its timing characteristics. These gaps are small enough so that the signal will jump over the gaps and travel from the starting point to the discharge point. In the case of separately applied fuel and oxidizer layers, this can be done by interrupting both the fuel and oxidizer layers or just one of the layers, for example, the oxidizer layer, while leaving the fuel layer continuous. This aspect of the invention is not limited to providing a simple gap in the timing strip, but the gap or gaps could be of any suitable geometry. For example, the gap or gaps may be provided in chevron-shaped, convoluted, or other suitable patterns.

Figure 12:
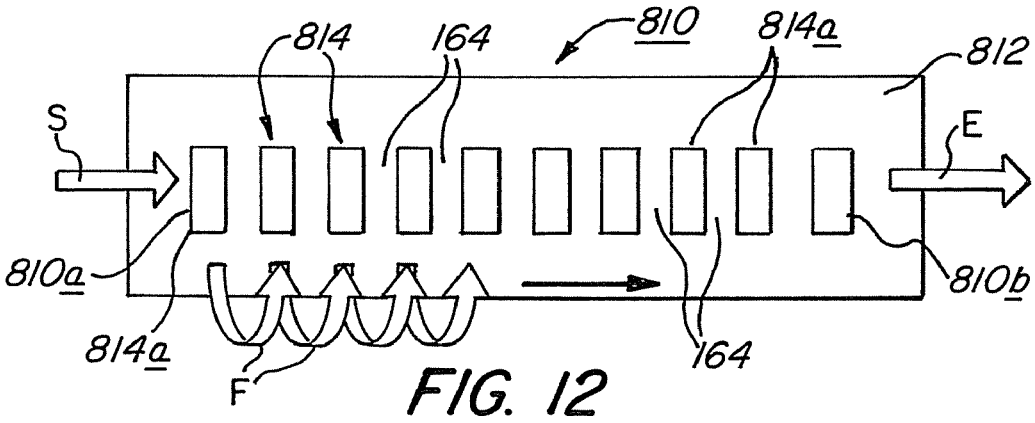
FIG. 12 is a schematic plan view of only the timing strip component on the substrate of a delay unit in accordance with a seventh embodiment of the present invention.

Referring now to FIG. 12, there is shown a delay unit 810 comprised of a substrate 812 having a timing strip 814 disposed thereon. (The pick-up charge and relay charge are omitted from FIG. 12, but input signal S and output signal E provided, respectively, by such pick-up and relay charges, are indicated by the labeled arrows.) As described above with respect to other embodiments, input signal S represents the input used to ignite the pick-up charge and output signal E represents the output of the ignited relay charge. Timing strip 814 is seen to have a plurality of jump gaps 164 formed between segments 814*a* of timing strip 814. "Jump gaps" as used herein and in the claims, means gaps which are not large enough to preclude transmission of the ignition signal along the timing strip. (This is in contrast to the terminal gaps described above which require bridging or closing by a bridging strip in order to permit the ignition signal to travel from the starting point to the discharge point of the timing strip.) When input signal S ignites the pick-up charge (not shown in FIG. 12) the output from the pick-up charge ignites the segment 814*a* closest to input arrow S and the output from that initial segment 814*a* flashes over the adjacent jump gap 164 to the proximate segment 814*a*, and that flashing over is repeated as indicated by the arrows F in FIG. 12, until the segment 814*a* closest to output arrow E ignites the relay charge (not shown in FIG. 12). The provision of jump gaps 164 slows the progress of the signal along the length of timing strip 814 because a delay is encountered at each of jump gaps 164. That is, it takes a somewhat longer time for the flash-over indicated by arrows F to occur than it would if timing strip 814 had no jump gaps 164 therein and simply burned continuously from its starting point or input end 810*a* to its finish point or output end 810*b*.

As indicated above, the regular sized and spaced gaps 164 are but one embodiment of jump gaps in the timing strip. The jump gaps could be differently sized, irregularly spaced, or provided in different shapes such as chevrons, convoluted lines, etc.

A delay unit may be configured with multiple printed timing strips connected at their starting points to a common input "bus" or to a common pick-up charge and at their discharge points to a common output "bus" or to a common relay charge. In this way the fastest burning strip always initiates the output charge. Since the distribution of actual burn times of the multiple timing strips is expected to be distributed normally, such an arrangement effectively truncates the normal distribution of burn times and decreases the standard deviation. Although the nominal burn time is also shifted in the process, this can be compensated for by adjusting the length of the strips. The result is a decrease of the standard deviation of burn times of the individual strips. The low critical diameter of printed nanoenergetic material timing strips allows a large number to be deposited on the substrate, leading to a significant improvement in timing variation performance among many mass-produced delay units of the present invention.

Figure 13:
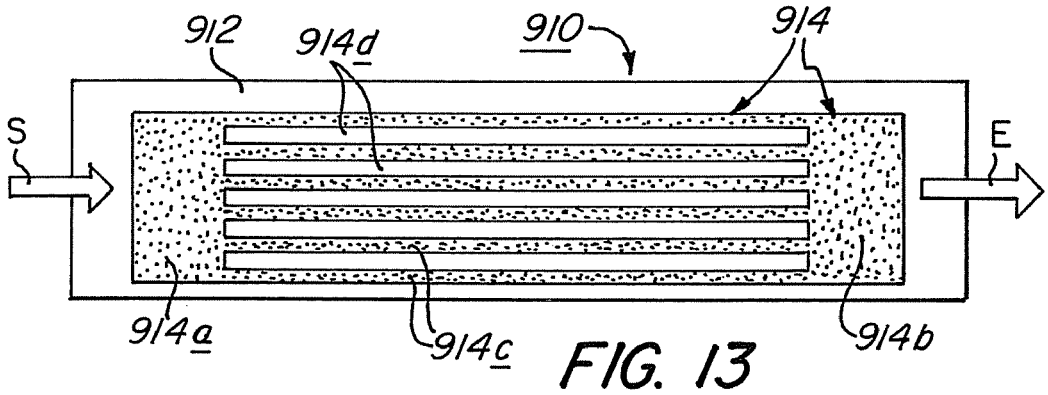
FIG. 13 is a schematic plan view of only the timing strip component on the substrate of a delay unit in accordance with an eighth embodiment of the present invention.

Referring now to FIG. 13, there is shown a delay unit 910 comprising a substrate 912 on which is disposed a timing strip 914. As in FIG. 12, the pick-up charge and relay charge are omitted from FIG. 13, but input arrow S schematically indicates input to the pick-up charge and output arrow E schematically indicates output from the relay charge. In this embodiment, timing strip 914 comprises an input "bus" section 914*a* connected to an output "bus" section 914*b* by a plurality of linear strips 914*c*. Linear strips 914*c* are separated from each other by longitudinally-extending gaps 914*d*. In the geometry of timing strip 914, longitudinally-extending gaps 914*d* do not interrupt the signal but merely separate linear strips 914*c* from each other. It will be appreciated that "bus" 914*a* and "bus" 914*b* could be eliminated and linear strips 914*c* could directly connect the pick-up charge to the output charge. Bus 914*a* and bus 914*b* provide an advantage in that their large area as compared to one of the strips 914*c* provide a larger quantity of energetic material adjacent to both the pick-up and relay charges (not shown in FIG. 13, but located, respectively, at about the locations of arrows S and E). The enhanced quantity of energetic material helps to insure reliable signal transfer communication from a pick-up charge (at arrow S) and to the relay charge (at arrow E).

In this embodiment, the fastest burning of the linear strips 914*c* will set the timing of the burning from input section 914*a* to output section 914*b*.

A delay unit of the present invention which is particularly well adapted to be formed into a configuration other than a flat configuration is particularly useful as a fuze component. During the first step of fabrication of this type of delay unit, a timing strip or strips as described above is applied to a thin, flexible substrate, for example, paper, reinforced paper, Tyvek® sheet, Mylar® sheet, plastic or like material. The substrate may be rectangular in shape. Next, pick-up and relay charges are printed or otherwise applied to either end of the substrate so that they connect with or overlap the timing strip. A thin, flexible laminate composed of any suitable material, e.g., a material which is identical or similar to that of the substrate, is applied so that it covers the timing strip completely, but leaves the pick-up and relay charges exposed. The laminate can be attached to the substrate using an adhesive, mechanical means, or any suitable means. The assembly can now be rolled or otherwise formed into a suitable shape for insertion into a holder or container. For example, the laminate may be rolled into a cylinder and inserted into a standard cylindrical detonator shell. In this case, a plug, which optionally may be tapered and may be made of any suitable material, e.g., a suitable plastic, is inserted inside the detonator shell to mechanically hold it in place and to prevent the input signal to the detonator from flashing through to either the relay charge or the detonator output charge, thereby by-passing the timing strip. The assembly constitutes a delay element, as the input signal ignites the pick-up charge, burns the timing strip, and ignites the relay charge.

Figure 14:
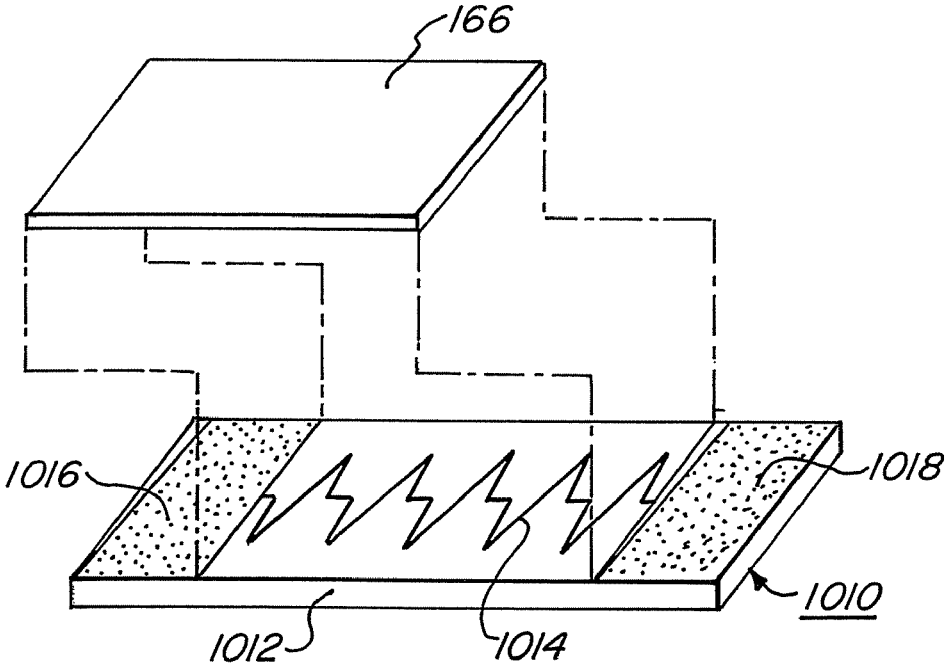
FIG. 14 is a schematic, exploded perspective view of a delay unit in accordance with a ninth embodiment of the present invention.

FIG. 14 shows an exploded perspective view of a delay unit 1010 comprised of a substrate 1012 on which is disposed a timing strip 1014 which connects a pick-up charge 1016 to a relay charge 1018. Delay unit 1010 may comprise any embodiment of the present invention including any of the different embodiments described above provided that the substrate 1012 is of thin, flexible construction, i.e., substrate 1012 must be capable of being rolled or folded as described below. Further, timing strip 1014, pick-up charge 1016 and relay charge 1018 must adhere to substrate 1012 even when the latter is rolled or folded. In this embodiment, a similarly thin, flexible laminate sheet 166 is applied to substrate 1012 so as to cover timing strip 1014 but leave pick-up charge 1016 and relay charge 1018 exposed. Preferably, laminate sheet 166 covers all of timing strip 1014.

Figure 14A:
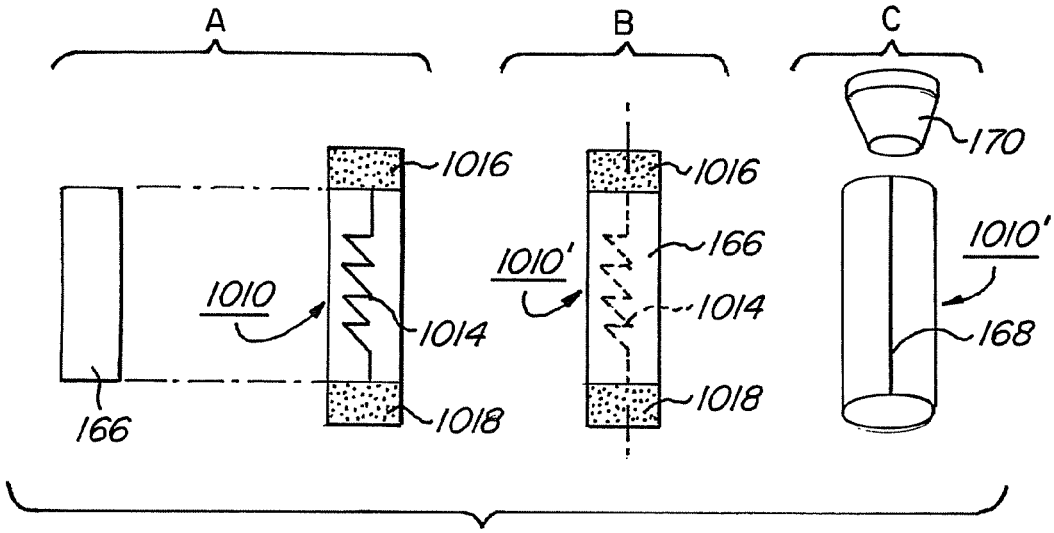
FIG. 14A is a schematic illustration, reduced in size relative to FIG. 14, showing steps in the production of the delay unit of FIG. 14.
Figure 15:
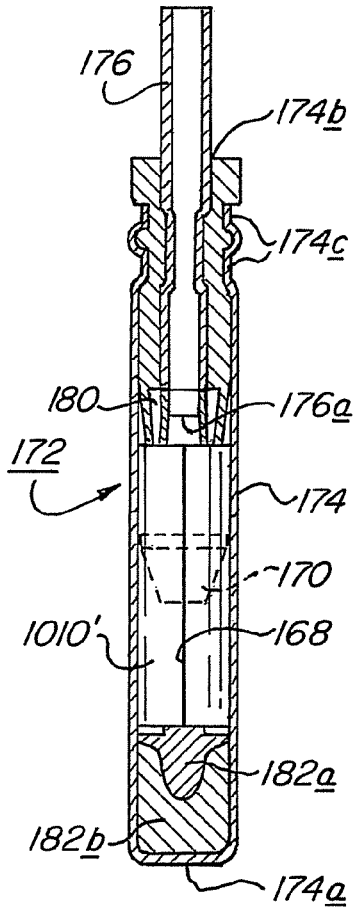
FIG. 15 is a cross-sectional view of a delay detonator containing the delay unit of FIG. 14.

FIG. 14A schematically shows the assembly steps in which laminate sheet 166 is applied over timing strip 1014 of delay unit 1010 in step A to provide the laminated delay unit 1010' shown in step B. Laminated delay unit 1010' is then rolled along its longitudinal axis L-L into the cylindrical configuration shown in step C of FIG. 14A. The cylindrical configuration may be maintained simply by inserting the cylindrically-rolled laminated delay unit 1010' into the shell of a detonator as illustrated in FIG. 15. Alternatively, or in addition, the seam 168 of cylindrically-rolled laminated delay unit 1010' may be secured by adhesive, mechanical means or any other suitable means to retain the cylindrical shape.

A tapered plug 170 may be inserted within cylindrically-rolled laminated delay unit 1010' as described below in connection with FIG. 15.

FIG. 15 shows a detonator 172 which is of conventional construction except for the utilization therein of laminated delay unit 1010' (laminated delay unit 1010 rolled into a tube) in lieu of a conventional delay strip. Opposite edges of delay unit 1010' are in abutting contact to form a seam 168. Thus, detonator 172 comprises a shell 174 having a closed end 174*a* and an open end 174*b*. A conventional shock tube fuse 176 is retained within open end 174*b* by a convention bushing 178 which is secured in place by crimps 174*c* as well known in the art. A conventional isolation cup 180 is positioned at the end 176*a* of shock tube fuse 176 in order to prevent static discharge, as well known in the art. Adjacent the closed end 174*a* of shell 174 is a primary charge 182*a* and a main output charge 182*b* of conventional configuration.

Tapered plug 170 is inserted within laminated delay unit 1010 for a distance sufficient to leave pick-up charge 1016*a* exposed. Tapered plug 170 does not interfere with the ignition of timing strip 1014 by pick-up charge 1016 because the tapered plug 170 is separated from timing strip 1014 by laminate sheet 166. Laminate sheet 166 protects timing strip 1014 both against abrasion, e.g., by tapered plug 170, and delamination from substrate 1012 during the rolling operation.

Figure 16:
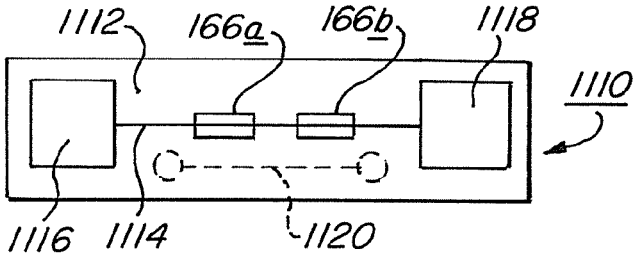
FIG. 16 is a schematic plan view of a delay unit in accordance with a tenth embodiment of the present invention.

Referring now to FIG. 16, there is shown a delay unit 1110 comprised of a substrate 1112 on which is shown a functioned calibration strip 1120. The substrate 1112 has thereon a pick-up charge 1116 and a relay charge 1118 which are connected by a timing strip 1114. A pair of retardants or accelerants 166*a*, 166*b* are shown applied to timing strip 1114. A retardant or accelerant will be selected and the dimensions of the portions thereof which will be in contact with timing strip 1114 will be selected to provide a desired burn time of timing strip 1114, depending on the test results obtained by functioning of calibration strip 1120. The retardant or accelerant 166*a*, 166*b* may, if desired, extend across the entire effective length of timing strip 1114. A retardant may comprise heat sink materials such as a layer of fine metal particles, e.g., copper, which will serve as a heat sink and absorb heat from the burn reaction, thereby retarding it. Alternatively, an accelerant comprising an energetic material having a higher burn rate than the energetic material of which timing strip 1114 is comprised may be applied in order to increase the burn rate of timing strip 1114.

Figure 17A:
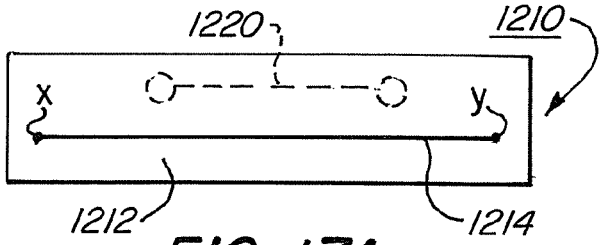
FIGS. 17A and 17B show steps in the manufacture of an eleventh embodiment of the present invention.
Figure 17B:
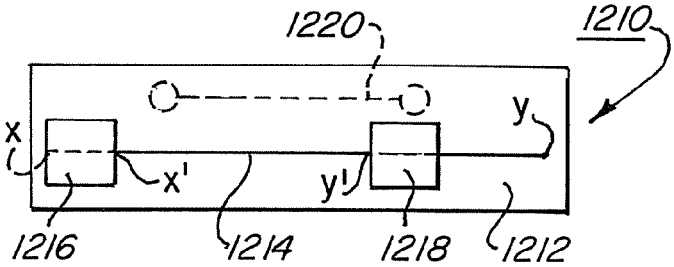

FIG. 17A shows a stage of production of a delay unit 1210 having on substrate 1212 a functioned calibration strip 1220 and a timing strip 1214 which extends from point x to point y, providing a length of timing strip 1214 which is at least equal to, but preferably greater than, the desired effective length required to attain the desired delay period. Based on the data obtained by functioning calibration strip 1220, pick-up charge 1216 and relay charge 1218 are applied to substrate 1212 at a distance separated from each other to provide an initial point x' and a discharge point y' along timing strip 1214. The distance along timing strip 1214 between the points x' and y' provide the effective length of timing strip 1214 and is selected to provide the desired delay period. Any suitable expedient, such as extending relay charge 1218 rightwardly as viewed in FIG. 17B, may be used to insure that relay charge 1218 initiates the next stage of the device.

Generally, any one or more "adjustment structures", i.e., jump gaps, retardants, accelerants, bridging strips or placement of pick-up and/or relay charges, may be used to adjust the burn time and therefore the delay period of the delay unit. The configuration and/or composition of the adjustment structure may either be predetermined or based on data derived from functioning the calibration strip.

While the invention has been described in detail with respect to a specific embodiment thereof, it will be appreciated that the invention has other applications and may be embodied in numerous variations of the illustrated embodiment. For example, the delay unit of the invention may be used in explosive or signal transfer devices other than detonators, and is generally usable in any device in which it is desired to interpose a time delay between explosive or energetic events.

What is claimed is:

1. A delay unit comprising a substrate having deposited thereon at least one timing strip having a starting point and a discharge point spaced apart from each other, the distance along the timing strip between the starting point and the discharge point defining the effective length of the timing strip, wherein the timing strip comprises a first strip contacting the starting point and having a terminal gap between the first strip and the discharge point, and a bridging strip connecting the first strip to the discharge point whereby to close the terminal gap so that the first strip and the bridging strip cooperate to define the effective length of the timing strip between the starting point and the discharge point, the timing strip comprising an energetic material capable of conducting an energy-releasing reaction therealong.

2. The delay unit of claim 1 wherein the energetic material comprises nanosize particles.

3. The delay unit of claim 1 wherein the timing strip comprises a first strip and a second strip separated from each other by a gap and a bridging strip connecting the first strip to the second strip to close the gap, the first, second and bridge strips cooperating to connect the starting point to the discharge point and thereby define the effective length of the timing strip between the starting point and the discharge point.

4. The delay unit of claim 3 wherein the energetic material comprises nanosize particles.

5. The delay unit of claim 1 further comprising a pick-up charge in signal transfer communication with the starting point of the timing strip and a relay charge in signal transfer communication with the discharge point of the timing strip.

6. The delay unit of claim 1 further comprising at least one of (a) a pick-up charge in signal transfer communication with the starting point of the timing strip, and (b) a relay charge in signal transfer communication with the discharge point of the timing strip, and wherein a portion of the timing strip is covered by at least one of the charges whereby the effective length of the timing strip is determined by placement of the charge or charges.

7. The delay unit of claim 6 wherein both the pick-up charge and the relay charge are present and at least one of the charges covers a portion of the timing strip.

8. The delay unit of claim 1 further comprising a pick-up charge spaced from a relay charge and a plurality of the timing strips connected in signal transfer communication at one end of the timing strips to the pick-up charge and at the other end of the timing strips to the relay charge, to provide redundant timing strips to initiate the relay charge.

9. The delay unit of claim 8 wherein the timing strip has a first bus area at its starting point and a second bus area at its discharge point, the first bus area being in signal transfer communication with the pick-up charge and the second bus area being in signal transfer communication with the relay charge.

10. The delay unit of claim 9 wherein the second bus area is enlarged relative to the timing strips whereby the energy released at the second bus area is greater than the energy released along the timing strips.

11. The delay unit of claim 1 wherein the oxidizer comprises $TiO_2$.

12. The delay unit of claim 1 wherein the timing strip comprises an adjustment structure selected from the class consisting of one or more jump gaps, one or more accelerants and one or more retardants.

13. The delay unit of claim 1 wherein the energetic material comprises nanosize particles of fuel M' and oxidant MyOx wherein M' and M are the same or different metals and y and x may be the same or different positive integers.

14. The delay unit of claim 13 wherein M' and M are selected from one or more of Ag, Al, B, Cu, Hf, Si, Sn, Ta, W, Y and Zr.

15. The delay unit of claim 13 wherein M' and M are selected from one or more of Al, Cu and Ag.

16. The delay unit of claim 1 wherein the timing strip is comprised of a major portion and a minor portion, the major portion having an effective length greater than that of the minor portion and the minor portion having a burn rate greater than that of the major portion, the disparity in the respective lengths and burn rates of the major and minor portions being great enough that the burn time of the minor portion is negligible compared to the burn time of the major portion so that the delay period of the delay unit is substantially determined by the burn time of the major portion.

17. A delay unit comprising a substrate having deposited thereon at least one timing strip having a starting point and a discharge point spaced apart from each other, the distance along the timing strip between the starting point and the discharge point defining the effective length of the timing strip, wherein the timing strip has a terminal gap between the starting point and the discharge point, and a bridging strip which closes the terminal gap to complete connection by the timing strip of the starting point to the discharge point, the timing strip comprising an energetic material capable of conducting an energy-releasing reaction therealong.

18. The delay unit of claim 1 or claim 17 wherein the substrate has deposited thereon a calibration strip comprising an energetic material capable of conducting an energy-releasing reaction therealong, the calibration strip and the timing strip being separated from each other sufficiently to preclude ignition of the timing strip by ignition of the calibration strip.

19. The delay unit of claim 1 or claim 17 wherein the energetic material of at least the timing strip is selected from the class consisting of a fuel and an oxidizer.

20. The delay unit of claim 1 or claim 17 wherein the energetic material of at least the timing strip is comprised of at least one discrete layer of fuel and at least one discrete layer of oxidizer, the layer of fuel and the layer of oxidizer being in contact with each other.

21. The delay unit of claim 20 wherein the energetic material of the calibration strip is substantially the same as the energetic material of the timing strip.

22. The delay unit of claim 1 or claim 17 wherein the energetic material of the calibration strip is substantially the same as the energetic material of the timing strip.

* * * * *